US007018763B2

(12) United States Patent
Matsumoto et al.

(10) Patent No.: US 7,018,763 B2
(45) Date of Patent: Mar. 28, 2006

(54) STATIC LATENT IMAGE DEVELOPING TONER, DEVELOPER AND IMAGE FORMING METHOD

(75) Inventors: Yoshiyasu Matsumoto, Hino (JP); Ken Ohmura, Hachioji (JP); Tatsuya Nagase, Tachikawa (JP); Kaori Soeda, Hino (JP)

(73) Assignee: Konica Corporation, (JP)

( * ) Notice: Subject to any disclaimer, the term of this patent is extended or adjusted under 35 U.S.C. 154(b) by 162 days.

(21) Appl. No.: 10/441,416

(22) Filed: May 20, 2003

(65) Prior Publication Data

US 2003/0219667 A1 Nov. 27, 2003

(30) Foreign Application Priority Data

May 24, 2002 (JP) ..... 2002-150457

(51) Int. Cl.
*G03G 9/08* (2006.01)

(52) U.S. Cl. ..... 430/108.7; 430/108.1; 430/110.1; 430/110.3; 430/137.14

(58) Field of Classification Search ..... 430/110.1, 430/137.14, 108.1, 108.7, 110.3
See application file for complete search history.

(56) References Cited

U.S. PATENT DOCUMENTS 4,254,201 A * 3/1981 Sawai et al. ..... 430/137.14
5,770,342 A * 6/1998 Okae et al. ..... 430/110.1

FOREIGN PATENT DOCUMENTS

JP 2001343780 A * 12/2001

OTHER PUBLICATIONS

Webster's New Riverside University Dictionary (1984) p. 86.*

* cited by examiner

*Primary Examiner*—Christopher RoDee
(74) *Attorney, Agent, or Firm*—Squire, Sanders & Dempsey L.L.P.

(57) ABSTRACT

The invention relates to a static latent image developing toner comprising toner particles, each of the toner particles comprising a toner intermediate particle having inorganic oxide particles on the surface, wherein a surface existence density of the inorganic oxide particle having a feret's diameter of 110 nm to 160 nm on the toner intermediate particle is 5 to 50 per $\mu m^2$, and relates to a developer comprising the toner and an image forming method utilizing the toner.

18 Claims, 3 Drawing Sheets

STATIC LATENT IMAGE DEVELOPING TONER, DEVELOPER AND IMAGE FORMING METHOD

TECHNICAL FIELD

The invention relates to a toner for developing a static latent image to be used for a copying machine or a printer, a developer containing the toner and a method for forming an image.

TECHNICAL BACKGROUND

As the image forming method using a static latent image developing method, typically an electrophotography, those described in U.S. Pat. Nos. 2,297,691 and 2,357,809 are cited. In such the methods, an image is finally formed by a process for forming a static latent image on a photoreceptor, a developing process for developing the static latent image to a toner image by a dry type developer containing at least a toner for developing the static latent image, a transfer process for transferring the toner image onto an image recording material such as paper, and a fixing process for fixing the toner image on the image recording material by heat or pressure.

In such the method, it is necessary for forming the final image with a suitable quality for a long period that the toner has high fluidity and stable electrification property. For improving the fluidity of the toner, a method by the addition of a fluidity improving agent such as silica fine powder as an external additive has been known.

As above-mentioned, the toner image is formed by developing the static image in the developing process. However, the toner forming the toner image is not completely transferred onto the recording material, also referred as to transferring material or image supporting material, and a part of the toner is usually remained on the photoreceptor.

The remained toner is usually recovered by a cleaning device and discarded. Recently, an image forming apparatus is noted from the economical or environmental viewpoint, which has a toner recycle system in which the retrieved toner is restored by a toner conveying screw to the developing device for reusing the developing toner or a cleaning-less system in which the residual toner is restored by the developing device on the occasion of the next image forming action.

However, the toner is received excessive physical compressing force by a toner recovering device such as the toner conveying screw when the usual small diameter toner containing the fluidity improving agent is applied to the image forming apparatus using the toner recycle system or the cleaning-less system. Consequently, the fluidity improving agent or the external additive to be on the surface of colored resin particle is buried into the colored resin particle so that the fluidity of the toner is gradually lowered and the electricity is changed, and problems such as scattering of toner, occurring of fog and lowering of image density are occurred.

Techniques for inhibiting the degradation of the fluidity of the toner caused by burying of the fluidity improving agent into the colored resin particle are proposed in, for example, Japanese Unexamined Patent Application Publication, hereinafter referred to as JP-A Nos. 9-211883, 10-104869 and 10-198063. JP-A Nos. 5-224456 and 2000-298372 describe technology in which a combination of an external additive with a large particle diameter and that with a small particle diameter is applied to the toner.

However, any method cannot sufficiently solve the problems at the present time. Recently, a toner with small diameter, particularly a polymerized toner, is noted for raising the image quality accompanied with the digitalization of the image forming apparatus. Moreover, the improvement of the transfer property for transferring the toner image with high fidelity without deformation is come as the theme of the investigation in the field.

It has been known that the toner produced by the polymerization method has merits that the particle diameter distribution and the charge distribution of the colored particles are sharp and the toner is excellent in the transfer ability. The method for forming the image without use of the cleaning device is going to be practically used. However, the reliance of the method is insufficient since it is difficult to completely remove the toner from the photoreceptor under any conditions of temperature and humidity.

A method by adding an external additive with a large particle diameter has been known for improving the transfer ability of the toner, for example, that disclosed in JP-A No. 11-38668. There is a problem on the external additive with the large that such the external additive is difficultly fixed with the colored particle so that the external additive released from the colored particle is transferred and accumulated on the photoreceptor even though such the external additive shows an effect to reduce the adhesive force of the toner with the photoreceptor.

Particularly in low temperature and low humidity condition, the released external additive is strongly charged and accumulation on the photoreceptor which finally causes a damage of the photoreceptor and a fault of the image.

SUMMARY

An aspect of the invention is to provide a toner for developing a static latent image which is excellent in the transfer ability without influence of the environment such as temperature and in the resolving power and has suitability for the cleaner-less process, a developer containing the toner and a method for forming an image.

The foregoing aspect can be attained by the following structures.

One structure of the invention is a static latent image developing toner comprising toner particles, each of the toner particle comprising a toner intermediate particle having inorganic oxide particles on the surface, wherein a surface existence density of the inorganic oxide particles having a feret's diameter of 110 nm to 160 nm on the toner intermediate particle is 5 to 50 per $\mu m^2$.

Another structure of the invention is a developer for developing a static latent image containing the static latent image developing toner.

A still other structure of the invention is an image forming method comprising: developing a static latent image formed on a photoreceptor by supplying the toner of claim 1 from a developing device to form a toner image on the photoreceptor; transferring the toner image onto a recording material; retrieving a residual toner, which is not transferred onto the recording material from the photoreceptor in the transferring step; restoring the residual toner to the developing device; and fixing the toner image transferred on the recording material.

DETAILED DESCRIPTION OF THE INVENTION

In the invention, a toner intermediate particle means a particle comprising a resin and a colorant, which is not subjected to a process of adding external additives such as the inorganic oxide particles. A toner particle means a particle, which is obtained by adding the external additives to the toner intermediate particle, and a static latent image developing toner (also referred to as merely a toner) means an powder-form aggregate of the toner particles.

The inorganic oxide particle usable in the invention is not limited. However, the inorganic oxide particle is preferably a particle of silica, titanium oxide, alumina, iron oxide, zirconia or cerium oxide, and is more preferably a particle of silica, titanium oxide, alumina or iron oxide. Among then, silica is particularly preferred.

Feret's diameter, and a number average feret's diameter according to the invention can be obtained by photographing the inorganic oxide particles or the toner having the inorganic oxide particles on the surface by a transmission type electron micrometer and calculating the feret's diameter by an image analysis apparatus. In the present invention, the inorganic oxide particles preferably have uniform diameter such as that 70% or more of the particles have the diameter in the range of ±10% of the number average feret's diameter. The feret's diameter of the inorganic oxide particle is-the maximum length of each of the photographed images of the inorganic oxide particles in one predetermined direction. The maximum length means the longest distance between one pair of parallel lines in the perpendicular direction to the predetermined direction and being tangent to the outer frame of the inorganic oxide particle.

Figure 4:
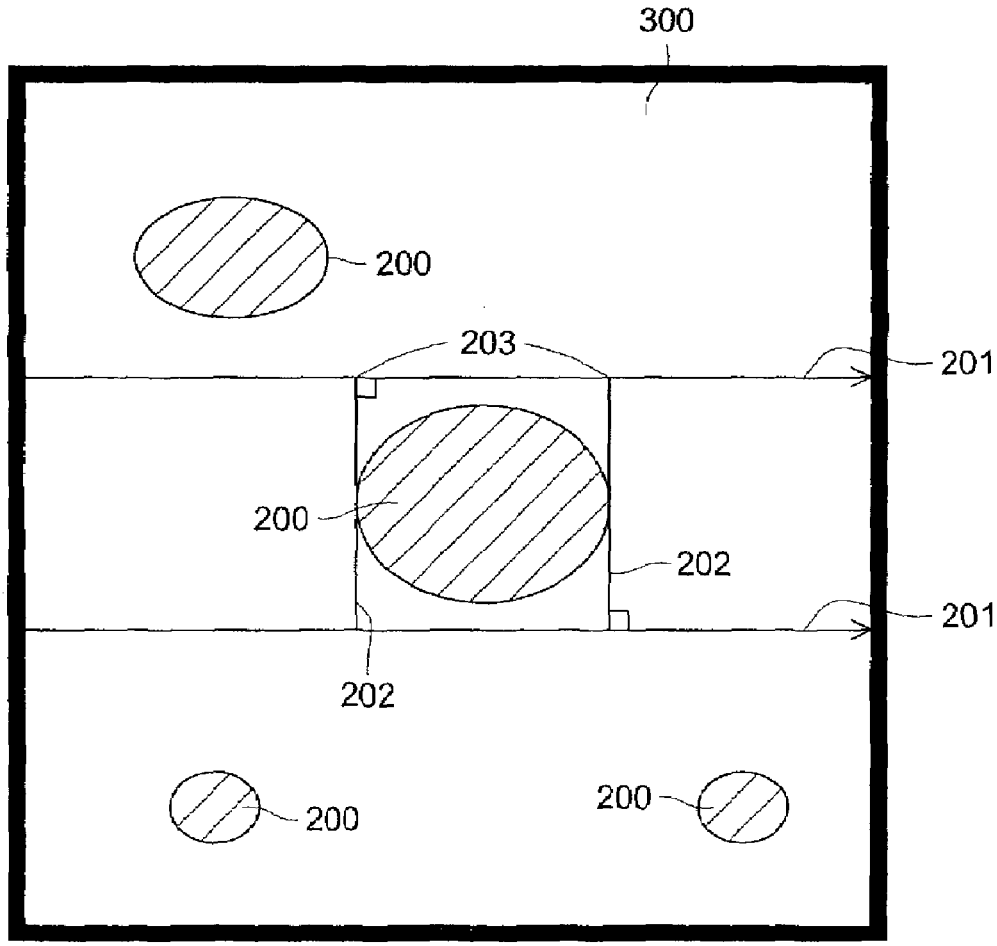
FIG. 4 is a schematic view showing a measuring method of the feret's diameter of the inorganic oxide particles.

The measuring method of the feret's diameter is explained by using FIG. 4. Firstly, one predetermined direction 201 of a photographed image 300 of inorganic oxide particles 200 observed by an electron micrometer. Feret's diameter 203 is a distance between a pair of lines 202, each of which is perpendicular to the predetermined direction 201 and is tangent to the outer frame of the inorganic oxide particle 200.

The surface existence density of the inorganic oxide particle on the toner intermediate particle surface is the number of the inorganic oxide particle having the feret's diameter of from 110 to 160 nm being on 1 μm×1 μm of the toner intermediate particle surface. A gold-palladium layer of 7 nm is evaporated on the surface of the toner particle and the particle is observed a field scanning electron microscope with an accelerating voltage of 5 kV, and the density is counted by an image analysis apparatus.

In the invention, the method for controlling the surface existence density of the inorganic oxide particle is not limited. For example, the surface existence density can be controlled by adjusting an adding amount of the inorganic particles having the predetermined feret's diameter in response to a surface area of the toner intermediate particles.

The transfer ratio of the toner is improved when the average value of feret's diameter of the inorganic oxide particles, which are added to the toner of the invention, is within the range of 110 to 160 nm, or the surface existence density of the inorganic oxide particles having the feret's diameter of 110 to 160 nm on the surface of the toner intermediate particle is within the range of from 5 to 50 μm. Consequently, the suitability to the cleaner-less process of the toner is improved and the effect of the invention can be promoted. The surface existence density of the inorganic oxide particles is preferably from 10 to 30/μm$^2$.

The moisture content of the toner and the inorganic oxide particles is measured by a Karl-Fischer type moisture content measuring apparatus. The sample to be measured by is stood for 4 hours under a condition of 20° C. and 50% RH, and then closed in a sample tube for measuring.

The moisture content of the toner is preferably from 0.2 to 2% by weight and that of the inorganic oxide particle is preferably from 4 to 12% by weight. The moisture content of the toner is more preferably from 0.6 to 1.5% by weight, and still more preferably 0.7 to 1.2% by weight.

The BET specific surface area (BET value) is measured by Gemini 2360, manufactured by Shimazu Seisakusho Co., Ltd.; nitrogen gas is adsorbed to the surface of the sample and the measurement is carried out by a multi plot BET method. The BET value is preferably from 1.1 to 4.2, more preferably from 1.3 to 1.9, from the viewpoint of the improvement of transfer ratio.

The preferable producing method of the inorganic oxide particle, the shape factor of the toner particle, the variation coefficient of the shape factor, the toner recovery method relating to the invention and the image forming method are described later.

The compounds, toner, developer, device, image forming method and image forming apparatus are described in detail below.

1. Synthesis of the Inorganic Oxide Particle

The production method of hydrophobic silica is described below as a synthesis example of the inorganic oxide particle.

A dispersion of hydrophilic silica fine particle is obtained by hydrolyzing and condensing a silane compound represented by Formula I or a hydrolysis product thereof in a mixture solution of a hydrophilic solvent such as methanol and ethanol, water and a basic compound such as ammonia and an organic amine compound.

$$Si(OR^3)_4 \qquad \text{Formula I}$$

In the formula, the groups represented by $R^3$ are each a monovalent carbon hydride group having 1 to 6 carbon atoms which may be the same or different for each other.

Thus obtained fine particle dispersion of hydrophilic silica is converted to an aqueous dispersion by adding water and distilling out the hydrophilic solvent to completely decompose the alkoxyl group remained at the surface of the fine particle.

One or more kinds of silane compound represented by Formula II or a hydrolysis product thereof are added to the aqueous dispersion of fine particle of hydrophilic silica to coat the surface of the fine particle of hydrophilic silica for obtaining a fine particle dispersion of hydrophobic silica.

$$R^2Si(OR^4)_3 \qquad \text{Formula II}$$

In the formula, $R^2$ is a monovalent carbon hydride group having 1 to 20 carbon atoms and the groups represented by $R^4$ are each a monovalent carbon hydride group having 1 to 6 carbon atoms which may be the same or different for each other.

Thus obtained aqueous fine particle dispersion of hydrophobic silica is converted to a ketone solvent dispersion of fine particle of hydrophobic silica by adding a ketone solvent and distilling out water. A silazane compound represented by Formula III and a silane compound represented by Formula IV are added to the ketone solvent dispersion of fine particle of hydrophobic silica to further make higher the hydriohobicity of the silica by trialkylsilizing the silanol group remaining at the surface of the silica fine particle for obtaining the objective silica particle.

$$R^1{}_3SiNHSiR^1{}_3 \qquad \text{Formula III}$$

In the formula, the groups represented by $R^1$ are each a mono-valent carbon hydride group having 1 to 6 carbon atoms, they may be the same as or different from each other.

$$R^1{}_3SiX \qquad \text{Formula IV}$$

In the formula, $R^1$ is the same as that in Formula III, and X is a —OH group or a hydrolysable group.

Concrete examples of the four-functional silane compound include an alkoxysilane such as tetramethoxysilane, tetraethoxysilane, tetraisoproxysilane and tetrabutoxysilane. Concrete examples of the partial hydrolyzed condensed compound of the four-functional silane compound represented by Formula I include methyl silicate and ethyl silicate.

There is no limitation on the hydrophilic organic solvent as long as it can dissolve water, the compound represented by Formula I and the partial hydrolyzed condensed compound thereof. Examples of the solvent include an alcohol; a cellosolve such as methyl cellosolve, ethyl cellosolve, butyl cellosolve, acetyl cellosolve; a ketone such as acetone and methyl ethyl ketone; and ether such as dioxane and tetrahydrofuran. The alcohols are preferable. Examples of the alcohols include a solvent represented by Formula V.

$$R^6OH \qquad \text{Formula V}$$

In the formula, $R^6$ is a monovalent carbon hydride group having 1 to 6 carbon atoms.

Concrete examples of the alcohol include methanol, ethanol, isopropanol and butanol. It is preferable to select the alcohol solvent according to the objective diameter of the silica fine particle since the diameter of the silica particle is made larger when the number of the carbon atoms in the alcohol is larger.

Examples of the forgoing basic compound include ammonia, dimethylamine and diethylamine, and ammonia is preferable. A required amount of the basic compound is dissolved in water and thus obtained basic solution is mixed with the hydrophilic organic solvent.

The amount of water to be used on this occasion is preferably from 0.5 to 5 moles per mole of alkoxyl group contained in the silane compound represented by Formula I or the partial hydrolyzed condensed compound thereof. The ratio of water to the hydrophilic organic solvent is preferably from 0.5 to 10% by weight; and the amount of the basic compound is preferably from 0.01 to 1 mole per mole of alkoxyl group contained in the silane compound represented by Formula I or the partial hydrolyzed condensed compound thereof.

The hydrolysis and condensation of the four-functional silane compound represented by Formula I is carried out by a know method in which the four-functional silane compound represented by Formula I is dropped into the mixture of the hydrophilic organic solvent and water containing the basic compound.

The conversion of the dispersion medium of the mixed solution dispersion of fine particles of silica to water can be carried out, for example, by adding water to the dispersion and distilling out the hydrophilic organic solvent, such the procedure may be repeated according to necessity. The amount of water to be used at this time is preferably from 0.5 to 2 times by weight of the total amount of alcohol, preferably about 1 time.

Concrete examples of the three-functional silane compound represented by Formula II include a trialkoxysilane such as methyltrimethoxysilane, methyltriethoxysilane, ethyltrimethoxysilane, ethyltriethoxysilane, n-propyltrimethoxysilane, n-propyltriethoxysilane, i-propyltrimethoxysilane, i-propyltriethoxysilane, butyltrimethoxysilane, butyltriethoxysilane and hexystrimethoxysilane. Partial hydrolyzed condensed compounds of them can also be used.

The adding amount of the three-functional silane compound is from 1 to 0.001 moles, more preferably from 0.1 to 0.01 moles, per mole of $SiO_2$ unit contained in the hydrophilic silica fine particle.

In the step for converting the dispersion medium of the aqueous dispersion of hydrophobic silica fine particle to the ketone solvent, the ketone solvent is added to the dispersion and water is distilled out, such the procedure may be repeated according to necessity. The amount of the ketone solvent to be added on this occasion is from 0.5 to 5 times, preferably from 1 to 2 times, by weight of that of the hydrophilic silica. The concrete examples of the ketone solvent to be used on this occasion include methyl ethyl ketone, methyl isobutyl ketone and acetyl acetone; and methyl isobutyl ketone is preferred.

Concrete examples of the silazane compound represented by Formula III include hexamethyldisilazane. Concrete examples of the one-functional silane compound represented by Formula IV include a monosilanol compound such as trimethylsilanol and triethylsilanol; a monochlorosilane such as trimethylchlorosilane and triethylchlorosilane; a monoalkoxysilane such as trimethylmethoxysilane and trimethylethoxysilane; a monoaminosilane such as trimetylsilyldimethylamine and trimethylsilyltrimethylamine; and a monoacyloxysilane such as trimethylacetoxysilane.

The using amount of these compounds is from 0.1 to 0.5 moles, preferably from 0.2 to 0.3 moles, per mole of $SiO_2$ unit contained in the hydrophilic silica fine particle.

The hydrophobic silica fine particle can be obtained in a powder state by an ordinary method.

2. Shape Factor, Variation Coefficient and Diameter Distribution of the Colored Particles in the Toner According to the Invention The toner preferably usable in the invention is described below.

In the toner according to the invention, it is preferable that toner particles having a shape factor of from 1.2 to 1.6 account for 65 number-% or more of the whole toner particles, a variation coefficient of the shape factor of from 4 to 16% and a number variation coefficient in the particle size distribution of from 8 to 27%. The shape factor of the toner particle according to the invention is defined by the following equation, which indicates the circular degree of the toner particle.

$$\text{Shape factor}=\{(\text{Maximum diameter}/2)^2\times\pi\}/\text{Projection area}$$

In the equation, the maximum diameter is the width of the particle at which the distance between one pair of parallel lines each contacting with the particle image projected on a plane is largest. The projection area is the area of the particle image projected on a plane. In the invention, the shape factor is determined by photographing the toner particle by a scanning electronmicroscope with a magnitude of 2,000 times and analyzing the photographed image by Scanning Image Analyzer, manufactured by Nihon Denshi Co., Ltd. The measurement is performed using the foregoing equation with respect to 100 toner particles.

The variation coefficient of the shape factor is calculated by the following equation:

$$\text{Variation coefficient of the shape factor (\%)}=(S^1/K)\times 100$$

In the equation, $S^1$ is the standard deviation of the shape factor with respect to 100 toner particles and K is the average of the shape factor.

The variation coefficient of the shape factor is preferably from 4 to 16%, more preferably from 6 to 14%. When the variation coefficient of the shape factor is from 4 to 16%, the electrifying distribution of the toner becomes sharp and the image quality is improved.

The number variation coefficient in the number distribution of particle size is calculated by the following equation:

$$\text{Number variation coefficient}=(S/Dn)\times 100$$

In the equation, S is the standard deviation in the number distribution of particle size and Dn is the number average diameter of the particles.

The number variation coefficient of the toner particles according to the invention is preferably from 8 to 27%, more preferably from 10 to 25%. When the number variation coefficient is from 8 to 27%, the offset of the toner is difficultly occurred since the space in the transferred toner layer is reduced and the fixing ability of the toner layer is raised. Moreover, the image quality is improved since the electrifying distribution becomes sharp and the transferring efficiency is raised.

There is no limitation on the method for controlling the number variation coefficient in the invention. For example, the classification of the toner intermediate particles in a liquid is more effective for making small the variation coefficient even though the classification by blowing can be applied. As the method for classification in the liquid, a method using a centrifugal machine can be applied in which the rotating number of the centrifugal machine is controlled so that the toner intermediate particles are separately recovered according to the difference of the sedimentation speed caused by the difference of the particle diameter.

The number distribution of particle size and the number variation coefficient of the toner particles according to the invention is described below. The number distribution of particle size and the number variation coefficient of the toner particles according to the invention are measured by Coulter Counter TA-II or Coulter Multisizer, manufactured by Coulter Co., Ltd., which is connected with a personal computer through an interface, manufactured by Nikkaki Co., Ltd., for outputting the particle size distribution. The volume particle diameter and the number particle diameter of not less than 2 μm are measured using an aperture of 100 μm and the particle size distribution and the average diameter are calculated.

The number distribution of particle size is the relative degree of the toner particle regarding the particle diameter, and the number average diameter is the diameter at the accumulative number of 50% in the number distribution of particle size Dn50.

The diameter of the toner particle according to the invention is preferably from 2 to 9 μm, more preferably from 3 to 6.5 μm, still more preferably from 3.5 to 6 μm, in the number average particle diameter.

The particle diameter within such the range can be controlled by the concentration of the coagulating agent or the salting out agent, the adding amount of the organic solvent, the adhering time or the composition of the polymer. The transfer efficiency is improved and the quality of a halftone image, a fine line and a dot image is raised by the toner since the number average particle diameter is made small so as to be from 2 to 9 μm.

The producing method of the toner to be used in the invention is described below.

3. Producing Method of the Toner

The producing method of the toner is not specifically limited, and a known method such as a crashing method and a polymerization method can be applied.

However, it is preferable that the toner according to the invention is prepared by a suspension polymerization method or a method by which a fine resin particle is formed by emulsion polymerization or mini-emulsion polymerization by a monomer dispersed in a liquid or aqueous medium containing an emulsion of a necessary additive, and then a coagulating agent such as an organic solvent or a salt is added into thus prepared resin dispersion to coagulate and fusion-adhere the resin particles.

Suspension Polymerization Method

A charge controlling resin is dissolved in a polymerizable monomer and various kinds of component such as a colorant, and a mold-releasing agent and a polymerization initiator are added according to necessity. The components are dissolved or dispersed in the polymerizable monomer by a homogenizer, sand mill, a sand grinder or an ultrasonic dispersing machine. The polymerizable polymer in which the components are dissolved or dispersed is dispersed in a state of an oil droplet having a designated size by a homomixer or a homogenizer in the aqueous medium containing the dispersion-stabilizing agent. Then the dispersion is charged into a reaction vessel having a stirring device and heated to progress the reaction. After the finish of the reaction, the dispersion stabilizing agent is removed from the dispersion and the polymerized particles are filtered, washed and dried to prepare the toner according to the invention. The aqueous medium in the invention is a medium containing 50% or more of water.

Emulsion Polymerization Method

A method by which resin particles are salted out, coagulated and fusion-adhered in the aqueous medium can also be applied to prepare the toner according to the invention. As examples of such the method, those described in JP-A Nos. 5-265252, 6-329947 and 9-15904 can be cited. Namely, the toner according to the invention can be formed by the method by which the resin particles and the dispersed particles of the component such as the colorant, or plural dispersed resin particles each comprises resin particle and colorant are salted out, coagulated and fusion-adhered, particularly by the following procedure. The particles are dispersed by using an emulsifying agent and salted out by the addition of the coagulating agent in a concentration larger than the critical coagulating concentration, on this occasion the system is heated by a temperature higher than the glass transition point of the resin so that the fusion-adhered resin particles are formed and gradually grown. Then a large amount of water is added to stop the growing of the particle at the time when the diameter of the adhered particle is reached to the designated diameter. Moreover, the surface of the particle is made smooth and the shape of the particle is controlled by further heating and stirring. Thereafter, the particles containing water in a fluid state are dried by heating. Thus the toner according to the invention can be obtained. A water-miscible solvent such as alcohol may be added together with the coagulating agent.

Concrete Producing Method

The production method is described referring a production example by the polymerization method.

Complex Resin Particle Obtained by Poly-Step Polymerization Method

An example of complex resin particle containing the mold-releasing agent in a zone other than the outermost layer is described.

The production is principally composed of the following processes.

1. A poly-step polymerization process I for obtaining a complex resin particles containing the mold-releasing agent in a zone other than the outer most layer, namely in the central or intermediate portion 2. A salting out/fusion-adhering process II for salting out/fusion-adhering the complex resin particles and a colorant particles to obtain toner intermediate particles 3. A filtering and washing process for separating the toner intermediate particles by filtration from the dispersion of the toner intermediate particles and removing the surfactant from the toner intermediate particles 4. A drying process for drying the toner intermediate particles after the washing 5. A process for preparing a toner by adding an external additive to the toner intermediate particles after the drying Each of the processes is described in detail below.

Poly-Step Polymerization Process I

The poly-step polymerization process I is a process for producing the complex resin particle by the poly-step polymerization method by which a covering layer composed of a polymer constituted by a monomer is formed on the surface of a resin particle.

In the invention, a three or more-step polymerization method is preferably applied from the viewpoint of the stability of the production and the anti-crashing strength of the toner.

The two-step polymerization method and the three-step polymerization method as typical examples of the poly-step polymerization method are described below.

Two-Step Polymerization Method

The two-step polymerization method is a method for producing the complex resin particle constituted by an outer layer or shell composed of low molecular weight resin and a central portion or nucleus composed of high molecular weight resin containing the mold-releasing agent.

In concrete, a monomer solution is prepared by dissolving the mold-releasing agent in a monomer K. and the monomer solution is dispersed in a state of an oil droplet into an aqueous medium such as an aqueous solution of a surfactant. This system is subjected to a polymerization treatment (the first polymerization step) to prepare a dispersion of high molecular weight resin particle containing the mold-releasing agent.

Thereafter, a polymerization initiator and a monomer K for obtaining the low molecular weight resin are added to the resin particle dispersion, and the monomer K is polymerized in the presence of the resin particle. Thus a covering layer composed of the low molecular weight resin or the polymer of the monomer K is formed on the surface of the resin particle.

Three-Step Polymerization Method

The three-step polymerization method is a method for producing the complex resin particle constituted by a central portion or nucleus composed of high molecular weight resin, an intermediate layer containing the mold-releasing agent and a outer layer or shell composed of low molecular weight resin.

In concrete, a resin particle dispersion prepared by an ordinary polymerization procedure (the first polymerization step) is added to an aqueous medium such as an aqueous solution of a surfactant, and a monomer solution composed of the monomer M and the mold-releasing agent dissolved in the monomer is dispersed in an oil droplet state in the aqueous medium. This system is subjected to a polymerization treatment (the second step polymerization) so as to form a covering layer (intermediate layer) constituted by resin (polymer of the monomer M) containing the mold-releasing agent on the surface of the resin particle (nucleus particle). Thus a dispersion of a complex resin particle constituted by the high molecular weight resin and the medium molecular weight resin is prepared.

Then the polymerization initiator and monomer K for obtaining low molecular weight resin are added to thus obtained dispersion of the complex resin particle, and the monomer K is subjected to a polymerization treatment (the third polymerization step) in the presence of the complex resin particle so as to form a covering layer constituted by low molecular weight resin (polymer of the monomer K) on the surface of the complex resin particle. The above-mentioned method is preferable since the mold-releasing agent can be finely and uniformly dispersed by applying the second polymerization step.

In the toner producing method relating to the invention, it is preferable that the polymerizable monomer is polymerized in the aqueous medium. Namely, the mold-releasing agent is dissolved in the monomer on the occasion of forming the resin particle (nucleus particle) or the covering layer (intermediate layer each containing the mold-releasing agent, and thus obtained monomer solution is dispersed in the aqueous medium in the form of oil droplet and the system is subjected to the polymerization treatment by addition of the polymerization initiator to prepare a latex particle.

The aqueous medium in the invention is a medium composed of from 50 to 100% by weight of water and from 0 to 50% by weight of a water-miscible organic solvent. Examples of the water-miscible organic solvent include methanol, ethanol, isopropanol, butanol, acetone, methyl ethyl ketone and tetrahydrofuran. An alcoholic organic solvent which cannot dissolve the formed resin is preferable.

By a method for mechanically forming the oil droplet so-called a mini-emulsion method, the mold-releasing agent dissolved in the oil phase is not released so that the sufficient amount of the mold-releasing agent can be introduced into the resin particle or the covering layer, different from the ordinary emulsion polymerization method.

There is no limitation on the dispersion apparatus for dispersing the oil droplet by mechanical energy. Examples of such the apparatus include a stirring apparatus Clearmix having a high speed rotor, manufactured by M-Technique Co., Ltd., an ultrasonic dispersion apparatus, a mechanical homogenizer, Manton-Goulin homogenizer and a compressing homogenizer. The diameter of the dispersed particle is preferably from 10 to 1,000 nm, more preferably from 50 to 1,000 nm, still more preferably from 30 to 300 nm.

Another polymerization method such as an emulsion polymerization method, a suspension polymerization method and a seed polymerization method can be applied for forming the resin particle or the covering layer each containing the mold-releasing agent. These polymerization methods may also be applied for forming the resin particle (nucleus particle) or the covering layer constituting the complex resin particle each containing no mold-releasing agent.

The diameter of the complex resin particle by the polymerization process I is preferably from 10 to 1,000 nm in the weight average particle diameter measured by an electrophoretic light scattering photometer ELS-800 manufactured by Ootsuka Denshi Co., Ltd.

The glass transition point Tg of the complex resin particle is preferably from 48 to 74° C., more preferably from 52 to 64° C.

The softening point of the complex resin particle is preferably from 95 to 140° C.

Salting Out/Fusion-Adhering Process II

The salting out/fusion-adhering process II is a process for forming an irregular shaped or non-spherical toner intermediate particle by salting out and fusion-adhering, at the same time, the complex resin particle prepared by the foregoing poly-step polymerization process I and the colorant particle.

The salting out/fusion-adhering means that the salting out or coagulation of the particles and the fusion-adhering or disappearing of the boundary between the particles are occurred at the same time or an action for occurring such the phenomena. For occurring the salting out and the fusion-adhering of the particles at the same time, it is necessary to coagulate the particles (the complex particles and the colorant particles) under a temperature condition higher than the glass transition point Tg of the resin constituting the complex resin-particle.

In the salting out/fusion-adhering process II, a particle of internal additive such as a charge controlling agent having a number average primary particle diameter of approximately from 10 to 1,000 nm may be salted out/fusion-adhered together with the complex resin particles and the colorant particles. The colorant particle may be subjected to surface modifying treatment. Know surface modifying agents can be used.

The colorant particle is subjected to the salting out/fusion-adhering treatment in the dispersed state in the aqueous medium. The aqueous medium, in which the colorant particle is dispersed, is preferably an aqueous solution containing the surfactant in a concentration higher than the critical micelle concentration.

The dispersing machine to be used for dispersing the colorant particles is preferably a pressure applying type dispersing apparatus such as a stirring apparatus having a high speed rotor Clearmix, manufactured by M-Technique Co., Ltd., an ultrasonic dispersing apparatus, a mechanical homogenizer, Manton-Goulin homogenizer, a compressing homogenizer; or a medium type dispersing apparatus such as a Getzman mill and a diamond fine mill, even though there is no specific limitation.

It is necessary for salting out/fusion-adhering the complex resin particles and the colorant particles to add a salting out agent or coagulating agent in an amount of not less than the critical coagulating concentration to the dispersion of the complex resin particles and the colorant particles and to heat the dispersion by a temperature higher than the glass transition point Tg of the complex resin particle.

The suitable temperature range for salting out/fusion-adhering is from (Tg+10° C.) to (Tg+50° C.), preferably from (Tg+15° C.) to (Tg+40° C.). A water-miscible organic solvent may be added for effectively progress the fusion-adhesion.

Filtration/Washing Process

A filtration treatment for separating the toner intermediate particles from the dispersion of the toner intermediate particle prepared in the foregoing processes and a washing treatment for removing the adhering materials such as the surfactant and the salting out agent from the filtered toner intermediate particles in a form of cake are applied in the filtration/washing process.

A centrifugal method, a vacuum filtration method using a Nutsche's funnel and a filtration method using a filter press may be use for the filtration process without any limitation.

Drying Process

This process is a process for drying the washed toner intermediate particles.

A spray drying apparatus, a vacuum freeze drying apparatus and a vacuum drying apparatus may be used in this process. The use of a stand still drying rack, a movable drying rack, a fluidized layer drying apparatus and a stirring drying apparatus are preferably used.

The moisture content of the dried toner intermediate particles is preferably not more than 5% by weight, more preferably not more than 2%.

The lump of the toner intermediate particles may be powdered when the colored particles are coagulated by weak inter-particle force. A mechanical powdering apparatus such as a jet mill, a Henschel mill, a coffee mill and a food processor can be used for powdering the colored particles.

As above-mentioned, the toner particles according to the invention is preferably prepared by the following procedure; the complex resin particle is formed without the presence of colorant and the dispersion of the colorant is added to the dispersion of the complex resin particle and then the complex resin particles and the colorant particles are salted out and fusion-adhered. The polymerization reaction for preparing the complex resin particle is not hindered when the preparation of the complex resin particle is carried out without presence of the colorant.

Moreover, any monomer or oligomer is not remained in the toner intermediate particle as a result of that the polymerization reaction for obtaining the complex resin particle is securely performed. Consequently, bad odor is not occurred in the course of the heat fixing in the image forming process using the toner.

The constitution of the toner producing process is described in detail below.

Polymerizable Monomer

A hydrophobic monomer is essential component as the polymerizable monomer for producing the binder resin to be used in the invention and a cross-linkable monomer may be used according to necessity. It is preferable to contain at least one kind of monomer having an acidic group or a basic group.

1. Hydrophobic Monomer

Known monomer can be used without any limitation as the hydrophobic monomer constituting the monomer component. One or more kinds of the monomer may be used for satisfying required properties.

In concrete, a mono-vinyl aromatic monomer, a (meth) acrylate monomer, a vinyl ester monomer, a vinyl ether monomer, a mono-olefin monomer, a di-olefin monomer and a halogenated olefin monomer may be used.

Examples of the vinyl aromatic monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

Example of the acryl monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

Examples of the vinyl ester monomer include vinyl acetate, vinyl propionate and vinyl benzoate.

Examples of the vinyl ether monomer include vinyl methyl ether, vinyl ethyl ether, vinyl isobutyl ether and vinyl phenyl ether.

Examples of the mono-olefin monomer include ethylene, propylene, isobutylene, 1-butene, 1-pentene and 4-methyl-1-pentene.

Examples of the di-olefin monomer include butadiene, isoprene and chloroprene.

2. Crosslinkable Monomer

The Crosslinkable monomer may be used for improving the property of the resin particle. Examples of the Crosslinkable monomer include divinylbenzene, divinylnaphthalene, divinyl ether, diethylene glycol methacrylate, ethylene glycol dimethacrylate and diallyl phthalate.

3. Monomer Having an Acidic Polar Group

Examples of the monomer having an acidic polar group include (a) (—COOH) and (b) α,β-ethylenic unsaturated compound having a sulfonic group (—$SO_3H$) are cited.

Examples the α,β-ethylenic unsaturated compound having a carboxylic group of (a) include acrylic acid, methacrylic acid, fumaric acid, maleic acid, itaconic acid, cinnamic acid, monobutyl maleate, monooctyl maleate and their salt of a metal such as Na and Zn.

Examples the α,β-ethylenic unsaturated compound having a sulfonic group of (b) include stylene sulfonic acid and its Na salt, allysulfosuccinic acid, octyl allylsulfosuccinate and their Na salt.

4. Monomer Having a Basic Polar Group

As the monomer having a basic polar group, (i) a (meth) acrylate of aliphatic alcohol having an amino group or a quaternary ammonium group and from 1 to 12, preferably form 2 to 8, particularly 2, carbon atoms, (ii) (meth)acrylic amide and a (meth)acrylic amide substituted by one or two alkyl groups each having from 1 to 18 carbon atoms at an optional nitrogen atom, (iii) a vinyl compound substituted by a heterocyclic group having a nitrogen atom the cycle thereof and (iv) N,N-di-allyl-alkylamine and the quaternary ammonium salt thereof, are exemplified. Among them, the (meth)acrylate of aliphatic alcohol having an amino group or a quaternary ammonium group is preferred as the monomer having the basic polar group.

Examples of the (meth)acrylate of the aliphatic alcohol having an amine group or a quaternary ammonium of (i) include dimethylaminoethyl acrylate, dimethylaminoethyl methacrylate, diethylaminoethyl acrylate, diethylaminoetyl methacrylate and their quaternary ammonium salt, 3-dimethylaminophenyl acrylate and 2-hydroxy-3-methacryloxypropyltrimethylammonium salt.

Examples of the (meth)acrylic amide and (meth)acrylic amide substituted by one or two alkyl groups at an optional nitrogen atom of (ii) include acrylamide, N-butylacrylamide, N,N-dibutylacrylamide, pyridylacrylamide, amthacrylamide, N-butylmathacrylamide, N,N-dimethylacrylamide and N-octadecylacrylamide.

Examples of the vinyl compound substituted by a heterocyclic group having a nitrogen atom the cycle thereof of (iii) include vinylpyridine, vinylpyrrolidone, vinyl-N-methylpyridinium chloride and vinyl-N-ethylpyridinium chloride.

Examples of the N,N-di-allyl-alkylamine and the quaternary ammonium salt thereof of (iv) include N,N-diallylmethylammonium chloride and N,N-diallylethylammonium chloride.

Polymerization Initiator

In the invention, known radical polymerization initiators are optionally usable as long as they are water soluble. Examples of the initiator include a persulfate such as potassium persulfate and ammonium persulfate; an azo compound such as 4,4'-azo-bis-4-cyanovalerianic acid and its salt and 2,2'-azo-bis(2-amidinopropane) salt, and a peroxide compound. The foregoing radical polymerization initiator can be used as a redox type initiator by using together with a reducing agent when it is necessary. The use of the redox type initiator is preferred since the activity of the polymerization is raised, the polymerization temperature can be lowered and the polymerization period can be shortened.

For example, a temperature from 50 to 90° C. is applied for the polymerization even though the polymerization temperature can be optionally selected as long as the temperature is higher than the temperature for generating the radical of the radical of the initiator. When an ordinary temperature polymerization initiator such as a combination of hydrogen peroxide and a reducing agent such as ascorbic acid are used, the polymerization can be carried out at the room temperature or a little higher than the room temperature.

Chain Transfer Agent

Known chain transfer agents can be used for controlling the molecular weight of the resin. As the chain transfer agent, a compound having a mercapto group such as octylmercaptane, dodecylmercaptane and tert-docecylmercaptane is used even though there is no specific limitation. The compounds each having the mercapto group are preferably used since the bad odor occurrence on the occasion of the heat fixing is inhibited and the toner having a sharp molecular weight distribution can be obtained, which is excellent in the storage ability, the strength of fixed image and the anti-offset ability. Preferable examples of the mercapto compound include an ethylene glycol compound having the mercapto group such as ethyl thioglycolate, propyl thioglycolate, butyl thioglycolate, t-butyl thioglycolate, 2-ethylhexyl thioglycolate, octyl thioglycolate, decyl thioglycolate and dodecyl thioglycolate; a neopentyl glycol compound having the mercapto group; and a pentaerythritol compound having the mercapto group. Among them, an n-octyl-3-mercaptopropionate is particularly preferred from the viewpoint of inhibition of odor on the occasion of the fixing by heat.

Surfactant

It is preferable that the polymerizable monomer is dispersed in a form of an oil droplet in the aqueous medium using a surfactant for performing the mini-emulsion polymerization of the foregoing polymerizable monomers. As the surfactant for such the use, the following ionic surfactants are preferably usable even though there is no specific limitation on the surfactant.

Examples of the ionic surfactant include a sulfonate such as sodium dodecylbenzenesulfonate, a sodium arylalkylpolyethersulfonate, sodium 3,3-disulfondiphenylurea-4,4-diazo-bis-amino-8-naphthol-6-sulfonate, ortho-carboxybenzene-azo-dimethylaniline and sodium 2,2,5,5-tetramethyl-triphenylmethane-4,4-diazo-bis-β-naphthol-6-sulfonate; a sulfate such as sodium dodecylsulfate, sodium tetradecylsulfate, sodium pentadecylsulfate, sodium octylsulfonate; and a fatty acid salt such as sodium oleate, sodium laurate, sodium caprate, sodium caprylate, sodium caproate, potassium stearate and calcium oleate.

A nonionic surfactant is also usable. Concrete examples of the nonionic surfactant include polyethylene oxide, polypropylene oxide, a combination of polyethylene oxide and polypropylene oxide, an ester of polyethylene glycol with a higher fatty acid, an alkylphenolpolyethylene oxide, an ester of a higher fatty acid with polypropylene oxide and sorbitol ester.

In the invention, the surfactant is principally used as the emulsifying agent on the occasion of the emulsion polymerization, but it may be used in another process and for another purpose.

Molecular Weight Distribution of the Resin Particle and the Toner Particle

The molecular weight distribution of the resin of toner according to the invention preferably has peaks or shoulders in the region of from 100,000 to 1,000,000, and the region of form 1,000 to 50,000. It is more preferable that the resin has peaks or shoulders in the region of from 100,000 to 1,000,000, that of from 25,000 to 150,000 and that of from 1,000 to 50,000.

It is preferable that the resin of the resin particle at least contains a high molecular weight component having a peak or shoulder in the region of from 100,000 to 1,000,000 and a low molecular weight component having a peak or shoulder in the region of from 1,000 to less than 50,000. It is more preferable to further use a medium molecular weight component having a peak or shoulder in the region of from 15,000 to 100,000.

A gel permeation chromatography GPC method using tetrahydrofuran THF as the solvent is suitable for measuring the molecular weight of the toner or the resin. In concrete, 1.0 ml of THF is added to the sample of from 0.5 to 5 mg, concretely 1 mg, and sufficiently dissolved by stirring at a room temperature using a magnetic stirrer. Then the samples solution is filtered by a membrane filter with a pore size of from 0.45 to 0.50 μm and injected to GPC apparatus. The column is stabilized at 40° C. and THF is flown at a flow speed of 1.0 ml per minute and 100 μl of the sample having a concentration of 1 mg/ml is injected. A combination of polystyrene gel columns available in the market is preferably used as the column. Examples of the column include, a combination of Shodex GPC KF-801, 802, 803, 804, 805, 806 and 808, produced by Showa Denkou Co., Ltd., and TSK gel G1000H, G2000H, G3000H, G4000H, G5000H, G6000H, G7000H and TSK guard column, produced by Touso Co., Ltd. A refractive index detector or IR detector or a UV detector are preferably used as the detector. For the determination of the molecular weight of the sample, the molecular weight distribution of the sample is calculated using a calibration curve prepared by a monodispersed polystyrene standard particle. About 10 kinds of the polystyrene are preferably used for preparing the calibration curve.

Coagulation Agent

The coagulation to be used in the invention is preferably selected from metal salts.

Examples of the metal salts include a salt of monovalent metal such as an alkaline metal, for example, sodium, potassium and lithium; a salt of divalent metal such as an alkaline-earth metal, for example, calcium and magnesium, and manganese and copper; and a salt of trivalent metal such as iron and aluminum.

The concrete examples of the monovalent metal salt are sodium chloride, potassium chloride, lithium chloride; that of divalent metal salt are calcium chloride, zinc chloride, copper(II) sulfate, magnesium sulfate and manganese sulfate; and that of the trivalent metal salt are aluminum chloride and iron(III) chloride. These salts are properly selected according to the purpose. The critical coagulating concentration (coagulation value or coagulation point) of the divalent metal salt is smaller than that of the monovalent metal salt and that of the trivalent metal salt is further smaller.

In the invention, the critical coagulating concentration is an index relating the stability of the dispersed particle in the aqueous dispersion which shows the concentration of the coagulating agent at which the coagulation is occurred when the coagulating agent is added to the dispersion. The critical coagulating concentration is considerably varied depending on the latex it self and the dispersing agent. For example, the critical coagulating concentration is described in S. Okamura "Koubunshi Kagaku (Polymer Chemistry)" 17, 601, 1960. The value of the critical coagulating concentration can be known by the description. Besides, the critical coagulating concentration can be determined by measuring the ζ-potential of the dispersion while varying the concentration of the coagulating agent. The critical coagulation concentration can determined according to the concentration of the salt at which variation of the ζ-potential is beginning.

In the invention, the polymer fine particle dispersion is treated by the metal salt so that the concentration of the salt is made larger than the critical coagulating concentration. It is selected according to the purpose that the metal salt is added either directly or in a form of an aqueous solution. When the metal salt is added in the form of aqueous solution, it is necessary that the concentration of the metal salt is larger than the critical coagulating concentration with respect to the total volume of the polymer particle dispersion and metal salt solution.

In the invention, the metal salt as the coagulating agent is added so that the concentration of the metal salt is preferably not less than 1.2 times, more preferably not less than 1.5 times, of the critical coagulating concentration, even though as long as the concentration is higher than the critical coagulating concentration.

Colorant

As the colorant constituting the toner according to the invention (the colorant particle to be salted out/fusion-adhered with the complex resin particles), various kinds of inorganic pigment, organic pigment and dye are usable. As the inorganic pigment, known ones can be used. Examples of the inorganic pigment are shown below.

As the black colorant, for example, carbon black such as furnace black, channel black, acetylene black and lamp black; and a magnetic powder such as magnetite and ferrite are used. These pigments can be used solely or in combination. The adding amount of the pigment is from 2 to 20%, preferably from 3 to 15%, by weight of the polymer.

When the toner is used as a magnetic toner, the foregoing magnetite may be added. In such the case, it is preferable to be added to the toner in an amount of from 20 to 60% by weight for providing the designated magnetic property.

Known organic pigments and dyes can also be used. Concrete examples of the organic pigment and the dye are shown below.

Examples of the pigment for magenta and red include C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177 C.I. Pigment Red 178 and C.I. Pigment Red 222.

Examples of the pigment for orange and yellow include C.I. Pigment Orange 31, C.I. Pigment Orange 43, C.I. Pigment Yellow 12, C.I. Pigment Yellow 13 C.I. Pigment Yellow 14, C.I. Pigment Yellowv15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155 and C.I. Pigment Yellow 156.

Examples of the pigment for green and cyan include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

As the dye, for example, C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93 and C.I. Solvent Blue 95 are usable. A mixture of these can be used.

These organic pigments and the dyes can be used solely or in combination according to necessity. The adding amount of the pigment is from 2 to 20%, preferably from 3 to 15%, by weight of the polymer.

The surface of the colorant particle constituting the toner according to the invention may be modified. Know surface modifying agent such as a silane coupling agent, a titanium coupling agent and aluminum coupling agent can be preferably used. Concrete examples of the silane coupling agent include an alkoxysilane such as methyltrimethoxysilane, phenyltrimethoxysilane, methylphenyldimethoxysilane and diphenyldimethoxysilane; a siloxane such as hexamethyldisiloxane; γ-chloropropyltrimethoxysilane, vinyltrichlorosilane, vinyltriethoxysilane, vinyltriethoxysilane, γ-methacryloxypropyltrimethoxysilane, γ-glycidoxypropyltrimethoxysilane, γ-mercaptopropyl-trimethoxysilane, γ-aminopropyltriethoxysilane and γ-ureidipropyltriethoxysilane. Examples of the titanium coupling agent are Plenact TTS, 9S, 38S, 41B, 46B, 55, 138S and 238S, each produced by Ajinomoto Co., Ltd., and A-1, B01, TOT, TST, TAA, TAT, TLA, TOG, TBSTA, A-10, TBT, B-2, B-4, B-7, B-10, TBSTA-400, TTS, TOA-30, TSDMA, TTAB and TTOP, each produced by Nihon Soda Co., Ltd. The foregoing surface modifying agents are available in the market. Example of the aluminum coupling agent is Plenact AL-M manufactured by Ajinomoto Co., Ltd.

The adding amount of such the surface modifying agent is preferably from 0.01 to 20%, more preferably from 0.1 to 5%, of the colorant by weight.

The surface modifying can be performed, for example, by the method by which the surface modifying agent is added to the dispersion of the colorant particle and heated to react.

The colorant particles after surface modification is recovered by filtration and washing and filtration are repeated using the same solvent. Thereafter the particles are dried.

Mold-Releasing Agent

The toner used in the invention is preferably a toner comprising toner particles, which are prepared by fusion-releasing resin particles each enclosing the mold-releasing agent in the aqueous medium. The toner particle in which the mold-releasing agent is finely dispersed can be obtained by salting out/fusion-adhering the resin particle each enclosing the mold-releasing agent and the colorant particles.

In the toner according to the invention, low molecular weight polypropylene having an average molecular weight of from 1,500 to 9,000 and low molecular polyethylene are preferred. An ester compound represented by the following formula is particularly preferred.

$$R^1—(OCO—R^2)_n$$

In the formula, n is an integer of from 1 to 4, preferably from 2 to 4, more preferably from 3 to 4, particularly preferably 4. $R^1$ and $R^2$ are each a carbon hydride which may have a substituent. The number of the carbon atoms in the group represented by $R^1$ is from 1 to 40, preferably from 1 to 20, further preferably from 2 to 5 carbon atoms. The number of the carbon atoms in the group represented by $R^2$ is from 1 to 40, preferably from 16 to 30, further preferably from 18 to 26.

Typical examples of the compound are shown below.

1) $CH_3—(CH_2)_{12}—COO—(CH_2)_{17}—CH_3$
2) $CH_3—(CH_2)_{18}—COO—(CH_2)_{17}—CH_3$
3) $CH_3—(CH_2)_{20}—COO—(CH_2)_{17}—CH_3$
4) $CH_3—(CH_2)_{14}—COO—(CH_2)_{19}—CH_3$
5) $CH_3—(CH_2)_{20}—COO—(CH_2)_6—O—CO—(CH_2)—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

-continued

12) $CH_2-OH$
$CH-O-CO-(CH_2)_{26}-CH_3$
$CH_2-O-CO-(CH_2)_{26}-CH_3$

13) $CH_2-OH$
$CH-O-CO-(CH_2)_{22}-CH_3$
$CH_2-O-CO-(CH_2)_{22}-CH_3$

14) $CH_2-OH$
$CH-OH$
$CH_2-O-CO-(CH_2)_{26}-CH_3$

15) $CH_2-OH$
$CH-OH$
$CH_2-O-CO-(CH_2)_{22}-CH_3$

16) $CH_3-(CH_2)_{26}-COO-CH_2-C(CH_3)(CH_2-O-CO-(CH_2)_{26}-CH_3)(CH_2-O-CO-(CH_2)_{26}-CH_3)$

17) $CH_3-(CH_2)_{20}-COO-CH_2-C(CH_2CH_3)(CH_2-O-CO-(CH_2)_{20}-CH_3)(CH_2-O-CO-(CH_2)_{20}-CH_3)$

18) $CH_3-(CH_2)_{26}-COO-CH_2-C(CH_2-O-CO-(CH_2)_{26}-CH_3)(CH_2-O-CO-(CH_2)_{26}-CH_3)(CH_2-O-CO-(CH_2)_{26}-CH_3)$

19) $CH_3-(CH_2)_{20}-COO-CH_2-C(CH_2-O-CO-(CH_2)_{20}-CH_3)(CH_2-O-CO-(CH_2)_{20}-CH_3)(CH_2-O-CO-(CH_2)_{20}-CH_3)$

20) $CH_3-(CH_2)_{18}-COO-CH_2-C(CH_2-O-CO-(CH_2)_{18}-CH_3)(CH_2-O-CO-(CH_2)_{18}-CH_3)(CH_2-O-CO-(CH_2)_{18}-CH_3)$

21) $CH_3-(CH_2)_{16}-COO-CH_2-C(CH_2-O-CO-(CH_2)_{16}-CH_3)(CH_2-O-CO-(CH_2)_{16}-CH_3)(CH_2-O-CO-(CH_2)_{16}-CH_3)$

22) $CH_3-(CH_2)_{20}-COO-CH_2-C(CH_2-O-CO-CH_3)(CH_2-O-CO-CH_3)(CH_2-O-CO-CH_3)$

The adding amount of the foregoing compound is preferably from 1 to 30%, more preferably from 2 to 20%, still more preferably from 3 to 15%, of the whole toner by weight.

The toner according to the invention is preferably prepared by enclosing the foregoing mold-releasing agent in the resin particles by the mini-emulsion method, and salting out and fusion-adhering the resin particles with the colorant particles.

4. Electrophotographic Photoreceptor

In the invention, an organic photoreceptor is most frequently used as the electrophotographic photoreceptor, hereinafter also simply referred to as photoreceptor.

In the invention, the organic electrophotographic photoreceptor (organic photoreceptor) is an electrophotographic photoreceptor in which at least one of a charge generation function and a charge transfer function is depended on an organic compound. The charge generation function and the charge transfer function are essential for constitution of the photoreceptor. The organic photoreceptor wholly includes know organic photoreceptors such as a photoreceptor constituted by a known organic charge generation substance or an organic charge transfer substance and a photoreceptor constituted by a polymer complex having the charge generation function and the charge transfer function.

The constitution of the organic photoreceptor is described below.

Electro Conductive Substrate

A cylindrical electro conductive substrate is preferable used for the photoreceptor to be used in the invention since such the substrate is suitable for designing a small image forming apparatus even though both of a sheet-shaped and cylindrical electro conductive substrate may be used.

The cylindrical electro conductive substrate is a cylindrical substrate necessary for endlessly forming an image by rotation thereof. The substrate is preferably an electro conductive cylinder having a circular degree of not more than 0.1 mm and a fluctuation of not more than 0.1 mm. When the circular degree and the fluctuation are exceeding the forgoing range, a good image is difficultly formed.

Metal such as aluminum and nickel, a plastic drum on which aluminum, tin oxide or indium oxide is evaporated, and a paper-plastic drum coated with an electroconductive substance can be used as the electroconductive material. The electro conductive substrate preferably has a specific resistively of not less than $10^3$ Ω·cm.

A substrate having an anodized and sealed surface may be used for the electro conductive substrate to be used in the invention. The anodizing treatment is usually carried out in an acidic bath such as chromic acid, sulfuric acid, phosphoric acid, boric acid and a sulfamic acid, and the treatment in the sulfuric acid gives the most preferable results. In the case of the sulfuric acid treatment, the treatment is preferably carried out under the condition of a sulfuric acid concentration of from 100 to 200 g/l, an aluminum ion concentration of from 1 to 10 g/l, a liquid temperature of about 20° C. and an applying voltage of 20 V, but the condition is not limited to the above-mentioned. The average thickness of the anodized layer is usually not more than 20 μm, particularly preferably not more than 10 μm.

Intermediate Layer

In the invention, an intermediate layer, including a subbing layer, may be provided between the substrate and the photoreceptive layer for improving the adhesion between the electroconductive substrate and the photoreceptive layer or preventing the injection of charge from the substrate. Examples of the material of the interlayer include polyamide resin, vinyl chloride resin, vinyl acetate resin and a copolymer containing two or more kinds of repeating unit included in the foregoing resins. Among these subbing resins, the polyamide resin is preferable, by which the remaining potential accompanied with repeating operation can be reduced. The thickness of the interlayer using such the resins is preferably from 0.01 to 0.5 μm.

The interlayer using a hardenable metal-containing resin is most preferable in the invention, which is formed by hardening by heat a metal-containing resin such as a silane coupling agent and a titanium coupling agent. The thickness of the interlayer using the metal-containing resin is preferably from 0.1 to 2 μm.

The photoreceptor layer of the photoreceptor on the interlayer is preferably to have a structure in which the function of the photoreceptor is separated into the charge generation layer CGL and the charge transfer layer CTL, even though the photoreceptor layer may be constituted by single layer having both of the charge generation function and the charge transfer function. The remaining potential accompanied with the repeating of the image forming operation can be controlled at a lowered level and another electrophotographic property can be controlled so as to be suitable for the object by applying the function separated structure. In the photoreceptor to be negatively charged, it is preferable that the charge generation layer CGL is provided on the interlayer and the charge transfer layer CTL is further provided on the charge generation layer. In the photoreceptor to be positively charged, the order of the layer is reversed. The most preferable constitution of the photoreceptor used in the invention is the negatively charged photoreceptor constitution having the foregoing function separated structure.

The layer structure of the function separation type negatively charged photoreceptor is described below.

Charge Generation Layer

The charge generation layer contains a charge generation material CGM. Other than that, a binder resin and another additive may be contained according to necessity.

A known charge generation material can be used as the charge generation material CGM. For example, a phthaiocyanine pigment, an azo pigment, a perylene pigment and an azulenium pigment can be used. Among them, the CGM capable of most inhibiting the remaining potential accompanied with repeating of the image forming operation is one having a steric and electrical structure by which a stable coagulated structure between the plural molecules. In concrete, the CGM of the phthalocyanine pigment and the perylene pigment each having a specific crystal structure are exemplified. For example, the degradation of accompanied with the repeating use is little and the increasing of the remaining potential can be reduced a by the CGM such as a titanylphthalocyanine having the maximum peak at a Bragg angle 2θ of 27.2° of Cu—Kα ray and a benzimidazoleperylene having the maximum peak at a 2θ of 12.4°.

When a binder is used in the charge generation layer as the dispersion medium, formal resin, butyral resin, silicone resin, silicone-modified butyral resin and phenoxy resin are usable as the most preferable binder. The ratio of the binder resin to the charge generation material is preferably from 20 to 600 parts by weight per 100 parts by weight of the binder resin. The remaining potential accompanied with the repeating use is most reduced by the use of these resins. The thickness of the charge generation layer is preferably from 0.01 μm to 2 μm.

Charge Transfer Layer

The charge transfer layer contains a charge transfer material CTM and a binder resin for dispersing the CTM and forming the layer. The layer may contain an additive such as an anti-oxidant.

A know charge transfer material CTM can be used as the charge transfer material. For example a triphenylamine derivative, a hydrazone compound, a styryl compound, a benzidine compound and a butadiene compound are usable. Such the charge transfer material is usually dissolved in a suitable binder for forming the layer. Among them, the CTM capable of making smallest the increasing of the remaining potential accompanied with the repeating use is one showing a high transferring speed and having a difference of the ionization potential to that of the CGM to be used in combination is not more than 0.5 eV, preferably not more than 0.25 eV.

The ionization potential of the CGM or the CTM is measured by surface analysis apparatus AC-1 manufactured by Riken Keiki Co., Ltd.

Examples of the resin usable in the charge transfer layer CTL include polystyrene, acryl resin, methacryl resin, vinyl chloride resin, vinyl acetate resin, poly(vinyl butyral) resin, epoxy resin, polyurethane resin, phenol resin, polyester resin, alkyd resin, polycarbonate resin, silicone resin, melamine resin, and a copolymer containing two or more of the repeating unit of the above-mentioned resin. An organic semiconductive polymer such as poly-N-vinylcarbazole is also usable other than the foregoing electro resistive rein.

The polycarbonate resin is most preferred as the binder of the CTL since the resin improves the dispersing ability for the CTM and the electrophotographic properties. The ratio of the binder resin to the charge transfer material is from 1 to 200 parts per 100 parts of the binder resin by weight. The thickness of the charge transfer layer is preferably from 10 to 40 μm.

Protective Layer

Various kinds of resin layer can be provided as a protective layer. Particularly, the organic photoreceptor having a high mechanical strength can be obtained by providing the layer of a crosslinkable resin.

Example of the solvent or dispersing medium to be used for forming the interlayer, the photoreceptive layer and the protective layer include n-butylamine, diethylamine, ethylenediamine, isopropanolamine, triethanolamine, triethylenediamine, N,N-dimethylformamide, acetone, methyl ethylketone, methyl isopropyl ketone, cyclohexanone, benzene, toluene, xylene, cholorform, dichloromethane, 1,2-dichloroethane, 1,2-dichloropropane, 1,1,2-trichloroethane, 1,1,1-trichloroethane, trichioroethylene, tetrachloroethane, tetrahydrofuran, dioxoran, dioxane, methanol, ethanol, butanol, isopropanol, ethyl acetate, butyl acetate, dimethylsuofoxide and methyl cellosolve. The solvent or the dispersing medium is not limited to the above-mentioned. Dichloromethane, 1,2-dichloroethane and methyl ethyl ketone are preferably used. These solvents may be used solely of in combination of two or more kinds.

A coating method such as a dipping method, a spray coating method and a coating method by a round shaped amount controlling coating means is applicable. The spray coating method and the coating method by the round shaped amount controlling coating means such as a round slide hopper are preferable for inhibiting dissolution of the lower layer on the occasion of coating of the upper layer and for attaining uniform coating. The use of the coating method by the round shaped amount controlling coating means is most preferable for coating of the protective layer. The coating method by the round shaped amount controlling coating means is described in detail in, for example, JP O.P.I. No. 58-189061.

5. Image Forming Apparatus used in the Image Forming Method

Figure 1:
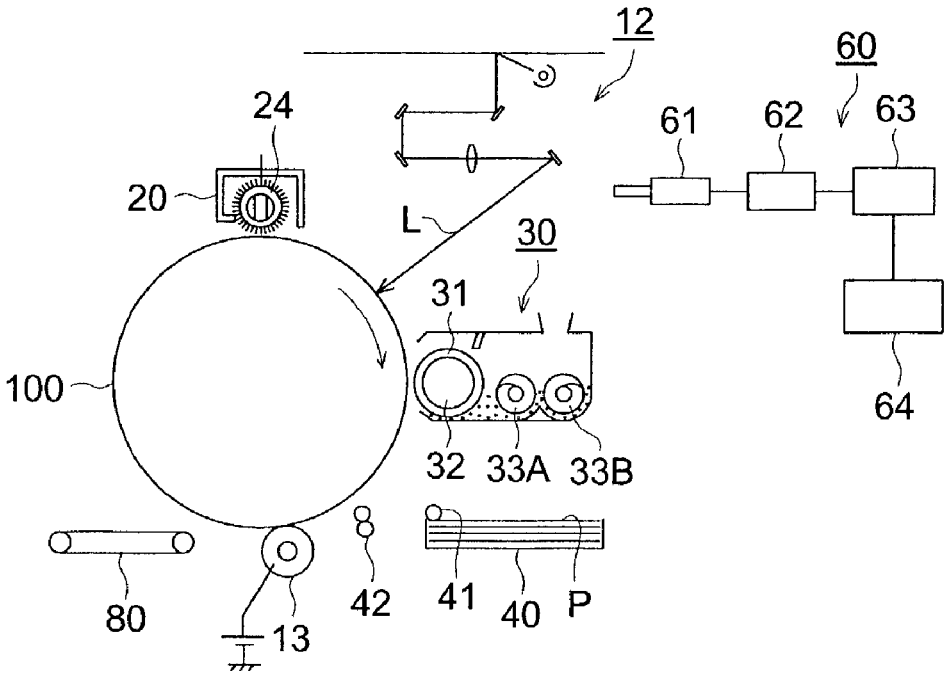
FIG. 1 is a view showing an example of a schematic construction of an image forming apparatus, which can be used in the invention.
Figure 2:
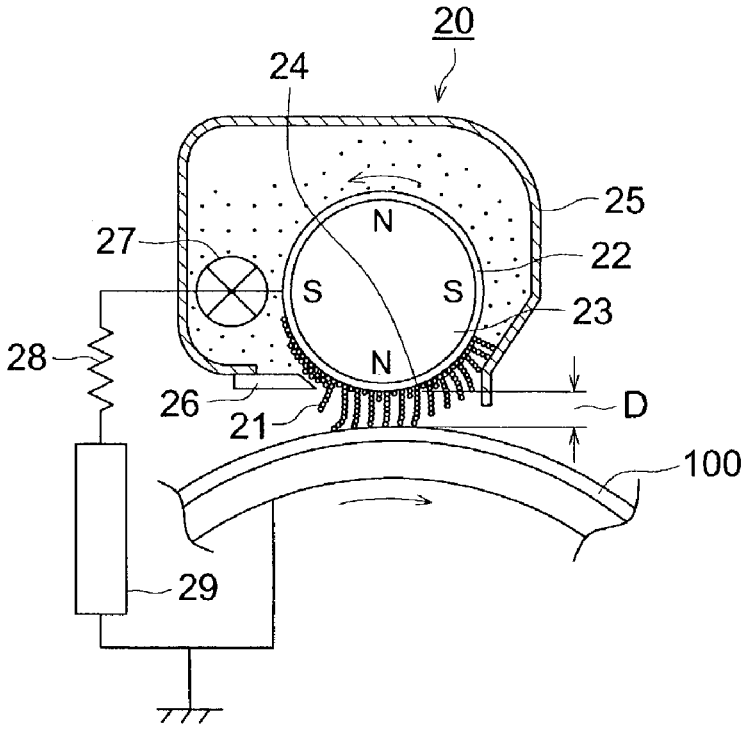
FIG. 2 is a view showing an example of a schematic construction of a magnetic brush charging apparatus, which can be used in the image forming apparatus.

The image forming apparatus to be used in the image forming method according to the invention is described referring FIGS. 1 and 2.

FIG. 1 shows a schematic drawing of an example of the image forming apparatus relating to the invention. The device 100 is a rotation type dram-shaped electrophotographic photoreceptor or photoreceptor drum. The photoreceptor drum is a charge injection type negatively charged OPC photoreceptor (organic photoconductive photoreceptor), which is clockwise rotated at a processing circumference speed of from 100 to 550 mm/second in the direction shown by the arrow in the drawing.

The device 20 is a magnetic brush charging device as a contact charging device for uniformly charging the surface of the photoreceptor drum 100 at the previously designated polarity and potential. The surface of the photoreceptor 100 is uniformly charged by a charge injection method by the magnetic brush charging device 20 at approximately −700 V.

The device 12 is a laser beam scanner as an image information writing means. The laser beam scanner 12 irradiates modulated laser beam L corresponding to the time serial electrical digital pixel signal of the image information input from a host apparatus, not shown in the drawing, to expose to light by scanning the uniformly charged surface of the photoreceptor drum 100. Thus a static latent image corresponding to the objective image information is formed on the circumference of the rotating photoreceptor drum 100 by the scanning of the laser light. A laser beam scanner available in the market can be used as the laser beam scanner.

30 is a developing device using a two-component developer composed of a non-magnetic toner and a magnetic carrier, which reversely develops the static latent image on the surface of the rotating photoreceptor drum 100 to form a toner image. The developing device 30 is preferably constituted by a developing roller having a fixed magnet 32 and a sleeve 31 rotating around the circumference of the magnet 32 in the same direction at a speed faster than that of the photoreceptor drum, and stirring devices 33A and 33B.

Thus obtained toner image is transferred onto an image receiving paper P which is conveyed by a paper supplying roller 41 and a timing roller 42 from the paper supplying cassette 40. The image receiving paper P carrying the toner image is conveyed into a fixing device to fix the toner image.

In the image forming apparatus, the measurement of the positive or negative discharge beginning voltage VTH is preferably carried out by a surface potential measuring device 60 arranged at just after the magnetic brush charging device 20. A potential measuring probe 61 of the potential measuring apparatus 60 is arranged at just after the magnet brush charging device 20 and the surface potential of the photoreceptor drum 100 is lead by a potential meter 62. The detected potential is amplified by an amplifier 63 and recorded by a recorder 64. On the occasion of the measurement, the developing device and the transferring means are paused and gradually increasing direct current positive or negative potential is applied to the magnet brush charging device, not shown in the figure. The rotating photoreceptor drum 100 is charged by contact with the magnetic brush charging means. The positive or negative discharge beginning potential VTH to the photoreceptor drum 100 is determined by the direct current potential at which the positive or negative potential is firstly detected on the photoreceptor drum 100 in the course of the increasing of the potential applied to the charging device.

It is a feature of the image forming apparatus to be used in the invention is that the cleaner-less process is utilized. An exclusive cleaning means or cleaning device is usually provided for removing the toner remained on the surface of the rotating photoreceptor drum 100 after the transfer of to the image receiving paper P by the transferring means or transferring device such as the transfer roller 13.

In the image forming apparatus according to the invention having no exclusive cleaning means or cleaning device, the remained toner is arrived at the position of the magnet brush charging device 20 contacting with the photoreceptor drum 100 by the rotation of the photoreceptor drum, and temporally recovered by a magnet brush, not shown in the figure, of a charging member 24 of the magnet brush charging device 20. The temporally recovered toner is released onto the surface of the photoreceptor drum 100 and finally recovered by the developing device 30 simultaneous with the developing, and the photoreceptor drum 100 is repeatedly used for image formation.

In the developing device having the cleaning function, a little amount of the toner remained on the photoreceptor drum is recovered by the bias potential for developing. The bias is the difference between the direct current voltage applied to the developing sleeve and the surface potential of the photoreceptor.

The remaining toner is recovered by the developing means and reused in the following operation by the simultaneous developing and cleaning. Consequently, any toner to be discarded is not formed and the maintenance is become not necessary. Moreover, the advantage in the space saving is large and the image forming apparatus can be considerably made compact since the cleaner-less system is utilized.

FIG. 2 is a schematic drawing showing the constitution of the magnetic brush charging device 20.

The magnetic brush charging device 20 is constituted by the magnetic brush charging member 24, a layer thickness controlling member 26 and a stirring member 27 which are included in a casing 25. The magnetic brush charging member 24 has a magnetic roller 23 having plural magnetic poles which are arranged so that the N pole and the S pole are alternatively positioned, a sleeve 22 rotating around of the magnetic roller in the direction of the same as or reverse to the rotating direction of the photoreceptor drum 100 and a magnetic brush 21 composed of a magnetic particle layer formed on the circumference of the sleeve. The magnetic brush 21 gives charge onto the photoreceptor drum by moving and brushing with the photoreceptor drum 100.

In the foregoing embodiment of the charge provision, the voltage is applied to the magnetic brush from a power source as a voltage applying means through a protective resistor 28. However, in the invention, alternative current voltage is applied overlapping with the direct current voltage since the charge can not be provided uniformly in some cases when the direct current is only applied. In such the case, the absolute value of the direct current voltage is preferably from 300 V to 1,000 V and the voltage of the alternative current in the peak to peak value Vp-p is preferably not less than 2 times, more preferably from 2 to 3 times, of the discharge beginning voltage VTH. The Vp-p value of the alternative current to be applied is preferably from 500 to 3,000 V.

The frequency of the alternative current f is preferably from 100 Hz to 5,000 Hz.

Image Forming Method

In the image forming method according to the invention, it is preferable to use the image forming apparatus having a cleaning means for recovering the toner remained on the photoreceptor drum by the developing device, and the development is simultaneously performed for visualizing the static latent image.

The image forming method can be obtained by the use of the toner according to the invention for forming, by which the effects of the invention can be obtained, namely, the fine colored particle with a diameter of not more than 1 μm is not formed in the cleaner-less system, an image defect of white line is reduced, scattering of the toner is inhibited, the life of the developer is increased and the fixing ability of the image is improved.

Figure 3:
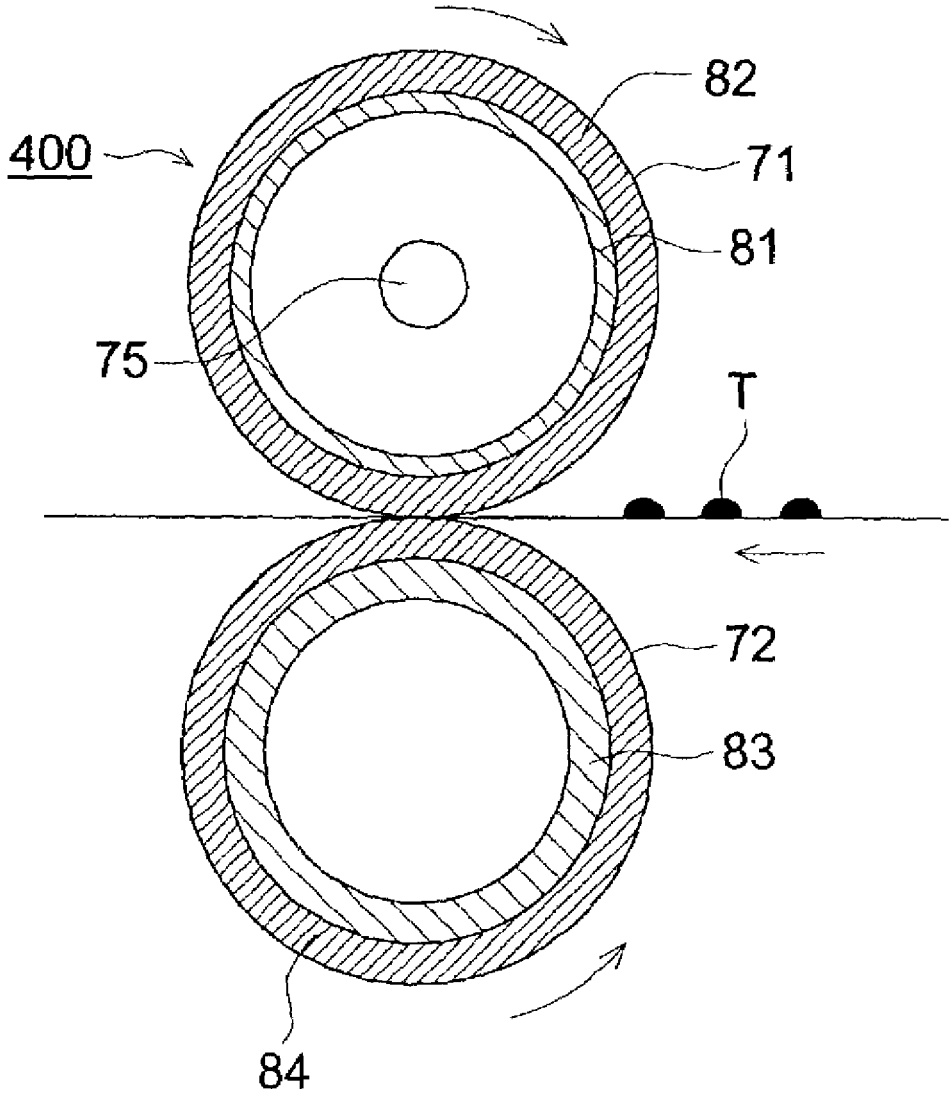
FIG. 3 is a cross sectional view showing an example of a schematic construction of a fixing apparatus, which can be used in the image forming apparatus.

FIG. 3 is a schematic drawing showing an example of the fixing device to be used in the image forming method according to the invention.

In FIG. 3, the fixing device has a heating roller 71 and a pressure roller 72 contacting to the heating roller. T is a toner image formed on the image receiving paper or an image supporting material.

The heating roller 71 constituted by a metal core 81 and a covering layer 82 formed on the metal core 81 and a heating member 75 composed of a line heater enclosed in the metal core. The covering layer is made from fluororesin or an elastomer.

The metal core 81 is made from metal and the internal diameter thereof is from 10 to 70 mm. As the metal for constituting the metal core 81, for example, a metal such as iron, aluminum and copper and an alloy thereof are usable even though the material of the metal core is not limited.

The thickness of the metal core 81 is from 1 to 15 mm, which is decided considering the balance between the requirement to reduce the thickness for energy saving and the strength depending on the material. For example, a thickness of 0.8 mm is necessary for an aluminum core to hold the same strength as that of an iron core having a thickness of 0.57 mm.

As the fluororesin forming the covering layer 82, polytetrafluoroethylen PTFE and tetrafluoroethylene-perfluoroalkylvinyl ether can be exemplified.

The thickness of the covering layer 82 composed of the fluororesin is from 10 to 500 μm, preferably from 20 to 400 μm.

When the thickness of the covering layer 82 composed of the fluororesin is less than 10 μm, the function of the covering layer cannot be sufficiently appeared and the durability of the fixing device cannot be maintained. Besides, when the thickness is exceeds 500 μm, a damage caused by paper powder is easily formed on the surface of the covering layer and contamination of the image caused by the toner adhered to the damage is occurred.

As the elastomer constituting the covering layer 82, silicone rubber or silicone sponge having a high heat resistively such as LTV, RTV and HTV is preferably used.

The Ascar C hardness of the elastomer constituting the covering layer 82 is less than 80°, preferably less than 60°.

The thickness of the covering layer 82 composed of the elastomer is from 0.1 to 30 mm, preferably from 0.1 to 20 mm.

As the heating member, a halogen heater can be suitably used.

The pressure roller 72 is constituted by a metal core 83 and a covering layer 84 formed on the metal core. As the elastomer, various kinds of soft rubber and sponge rubber such as urethane rubber and silicone rubber are usable even though there is no limitation. The silicone rubber and the silicone sponge rubber exemplified as the material of the covering layer 82 are preferably used.

The Ascar C hardness of the elastomer constituting the covering layer 84 is less than 80°, preferably less than 70°, more preferably less than 60°.

The thickness of the covering layer 84 is from 0.1 to 30 mm, preferably from 0.1 to 20 mm.

As the metal for constituting the metal core 83, a metal such as iron, aluminum and copper and an alloy thereof are usable even though the material of the metal core is not limited.

The total contact loading weight applied between the heating roller 71 and the pressure roller 72 is usually from 40 to 350 N, preferably from 50 to 300 N, more preferably from 50 to 250 N. The contact pressure is decided considering the strength of the heater roller 71 or thickness of the metal core 81, for example, a loading weight of not more than 250 N is preferred for a heating roller having the metal core having a thickness of 0.3 mm.

The width of nip is preferably from 4 to 10 mm from the viewpoint of the anti-offset ability and the fixing ability. The surface pressure at the nip is preferably from $0.6\times10^5$ Pa to $1.5\times10^5$ Pa.

Example of the fixing condition by the fixing device shown in FIG. 3 is a fixing temperature or the surface temperature of the heating roller 71 of from 150 to 210° C. at a line speed of from 230 to 900 mm/sec.

A cleaning mechanism may be attached to the fixing device. As the cleaning method, a method in which one of a kind of silicone oil is supplied to the fixing film and a method in which cleaning is performed by a pad, roller or web each immersed with a kind of silicone oil.

As the silicone oil, for example, polydimetylsiloxane, polymethylphenylsiloxane and polydiphenylsiloxane are usable. Fluorine-containing siloxane is also suitably usable.

EXAMPLES

The concrete embodiment and the effects of the invention are described; however the embodiment of the invention is not limited thereto. In the following description, "part" is "part by weight".

Preparation of Inorganic Oxide Particles

Spherical hydrophobic silica was prepared by the following procedure.

Inorganic Oxide Particle 1

Step 1

In to a three liter glass reaction vessel having a stirrer, a dropping funnel and a thermometer, 623.7 g of methanol, 41.4 g of water and 49.8 g of 28% ammonia water were charged and mixed. The mixture was controlled at 35° C. and 1163.7 g of tetramethoxysilane and 418.1 g of 5.4% were dropped into that each spending for 6 hours and 4 hours, respectively while stirring. The stirring was continued further 1 hour after the completion of the dropping of tetramethoxysilane for hydrolysis to obtain a suspension of silica fine particles.

An ester-adaptor and a cooler were attached to the glass vessel and the vessel was heated by within the range of from 70 to 90° C. to distill out methanol. When 1132 g of methanol was removed, 1200 g of water was added and the 273 g of methanol was removed by further heating at 70 to 90° C. Thus an aqueous silica suspension was obtained. Then the aqueous suspension was subjected to centrifugal treatment with 5,000 rpm for removing the precipitation of coarse particles.

Step 2

To the aqueous suspension, 11.6 g of trimethylmethoxysilane, the amount of 0.01 moles per mole of tetraethoxysilane, was dropped for 0.5 hours, and the suspension was further stirred 12 hours after the completion of dropping for treating the surface of the silica fine particle.

Step 3

To thus obtained dispersion, 1440 g of methyl isobutyl ketone was added, and the dispersion was heated at 80 to 110° C. and 1163 g of a methanol-water mixture was removed spending for 7 hours. Then 357.6 g of hexamethyldisilazane was added to the dispersion, and the dispersion was heated by 120° C. for 3 hours to progress the reaction for trimethylsilylizing the silica fine particle. Thereafter, the solvent was distilled out. Thus 342 g of spherical hydrophobic silica particles were obtained.

Inorganic Oxide Particle 2

Four hundreds and thirty two grams of spherical silica particles were obtained in the same manner as in the inorganic oxide 1 except that the hydrolysis temperature of tetramethoxysilane was changed from 35° C. to 48° C. and the adding amount of hexamethyldisilazane was changed from 357.6 g to 184.4 g on the occasion of the synthesis of the spherical hydrophobic silica particles.

Inorganic Oxide Particle 3

Four hundreds sixty grams of spherical silica particles were obtained in the same manner as in the inorganic oxide particle 1 except that the hydrolysis temperature of tetramethoxysilane was changed from 35° C. to 28° C. and the reaction time after the addition of hexamethyldisilazane was changed from 3 hours to 12 hours on the occasion of the synthesis of the spherical hydrophobic silica particles.

Inorganic Oxide Particles 4 to 7

Inorganic oxide particles 4 through 7 shown in Table 2 were prepared by changing the hydrolysis temperature and the reaction time of hexamethyldisilazane.

The characteristics of Inorganic oxide particles 1 to 7 are shown in following Table 2.

2. Preparation Example of Toner Intermediate Particles

Toner Intermediate Particle 1

Preparation Example of Resin Particle for Toner Latex 1HML (1) Preparation of Nucleus Particle (the First Step of Polymerization)

Into a 5,000 ml separable flask on which a stirrer, a thermal sensor, a cooling pipe and a nitrogen gas introducing device were attached, a surfactant solution composed of 3010 g of deionized water and, dissolved therein, 7.08 g of the following anionic surfactant was charged as an aqueous medium and the temperature in the flask was raised by 80° C. while stirring at a speed of 230 rpm under a nitrogen gas stream.

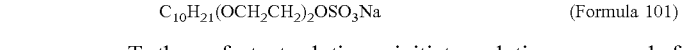

$C_{10}H_{21}(OCH_2CH_2)_2OSO_3Na$ (Formula 101)

To the surfactant solution, a initiator solution composed of 9,2 g of a polymerization initiator, potassium per sulfate KPS, and 200 g of deionized water was added and the temperature of the solution was raised by 75° C. Then a monomer mixture liquid composed of 70.1 g of styrene, 19.9 g of n-butyl acrylate and 10.9 g of methacrylic acid was dropped into the solution spending for 1 hour and the system was stirred at 75° C. for 2 hours to progress the polymerization (the first step of polymerization) to prepare a latex, a dispersion of resin particles each comprising polymer resin. The latex was referred to as Latex 1H.

(2) Formation of Interlayer (the Second Step of Polymerization)

In a flask with a stirrer, 98.0 g of exemplified compound 19 was added as the crystalline substance to a monomer mixture composed of 105.6 g of styrene, 30.0 g of n-butyl acrylate, 6.2 g of methacrylic acid and 5.6 g of n-octyl 3-mercaptopropionate, and the liquid was heated by 90° C. to dissolve the exemplified compound 19. Thus a monomer solution was prepared.

On the other hand, a surfactant solution prepared by dissolving 1.6 g of the surfactant of Formula 101 in 2700 ml of deionized water was heated by 98° C., and 28 g in the terms of solid component weight of Latex 1H which is the dispersion of the nucleus particle was added. The foregoing monomer solution of exemplified compound 19 was mixed and dispersed for 8 hours in the surfactant solution by a mechanical dispersing machine Clearmix, manufactured by M-Technique Co., Ltd., having a circulation pass to prepare a dispersion containing emulsified oil droplets.

Then an initiator solution composed of 5.1 g of polymerization initiator KPS and 240 ml of deionized water and 750 ml of deionized water were added to the dispersion. The system was heated and stirred for 12 hours at 98° C. for performing polymerization (the second step polymerization) to obtain latex which is a dispersion of a complex resin particle constituted by a resin particle of high molecular weight resin covered by a layer of intermediate molecular weight resin. The latex was referred to as Latex 1HM.

(3) Formation of Outer Layer

To thus obtained Latex 1HM An initiator solution composed of 7.4 g of the polymerization initiator KPS and 200 ml of deionized water were added, and a monomer mixture liquid composed of 300 g of styrene, 95 g of n-butyl acrylate, 15.3 g of methacrylate and 10.4 g of n-octyl 3-mercaptopropionate was dropped spending for 1 hour at 80° C. The heating and stirring were continued for 2 hours after completion of the addition by dropping to progress the polymerization (the third step of the polymerization). Then the system was cooled by 28° C. Thus latex was obtained. The latex was a dispersion of a complex resin particle constituted by the central portion of high molecular weight resin, the interlayer of intermediate molecular weight resin and the outer layer of low molecular weight resin, and the exemplified compound 19 was contained in the interlayer. The latex was referred to as Latex 1HML.

The resin particle constituting Latex 1HML had peaks of molecular weight distribution at 138,000, 80,000 and 13,000; and the weight average diameter of the complex resin particle was 122 μm.

Preparation of Toner Intermediate Particle

In 1,600 ml of deionized water, 59.0 g of an anionic surfactant, sodium dodecylsulfate, was dissolved; and 420.0 g of carbon black was gradually added to the solution while stirring. The mixture was subjected to a dispersing treatment by Clearmix manufactured by M-Technique Co., ltd. to prepare a dispersion of the colorant particles.

Into a four mouths flask as a reaction vessel on which a thermo-sensor, a cooler, a nitrogen gas introducing device and a stirrer were attached, 420.7 g of Latex 1HLM in the terms of solid component weight, 900 ml of deionized water and 166 g of the colorant dispersion were charged and stirred. The temperature in the vessel was controlled at 30° C., and the pH of the mixture was adjusted at 8 by addition of a 5 moles/liter solution of sodium hydroxide.

Then a solution of 12.1 g of magnesium chloride hexahydrate in 1,000 ml of deionized water was added spending for 10 minutes at 30° C. while stirring. After sanding for 3 minutes, the temperature of the system was raised by 90° C. spending for 30 minutes for forming an associated particle. The diameter of the associated particle was measured by Coulter Counter TA-II in such the situation. A solution of 80.4 g of sodium chloride in 1.000 ml of deionized water was added at the time when the number average diameter of the associated particles was come up to 6.4 μm to stop the growing the particle. Thereafter, the system was heated and stirred at 90° C. for 2 hours as a ripening treatment to complete the fusion-adhering of the particle.

The system was cooled by 30° C., and repeatedly washed by 60 times amount of ionized water after the pH was adjusted to 4.5. Then the solid phase was separated by a decanter type centrifugal machine and dried. Thus Toner intermediate particle 1 was obtained.

Toner Intermediate Particle 2

In 250 parts of ethyl acetate, 30 parts of Exemplified compound 19 was dissolved by heating and the solution was suddenly cooled by liquid nitrogen to separate the compound to form an ethyl acetate dispersion of the mold-releasing agent. The average diameter of the mold-releasing agent particles was 0.6 μm, which was measured by a laser diffraction/scattering particle size distribution measuring apparatus LA-700, manufactured by Horiba Seisakysho Co., Ltd. One hundred parts of polyester resin composed of a bisphenol A-propylene oxide adduct, a bisphenol A-ethylene oxide adduct and a tetrephthalic acid derivative having a Mw of 20,000, a Tg of 66° C. and a Tm of 106° C., 8 parts of carbon black and 80 parts of ethyl acetate were mixed and dispersed by a ball mill for 10 hours, and then 36 parts of the ethyl acetate dispersion of mold-releasing agent was added. The mixture was stirred for making uniform. The liquid was referred to as Liquid A.

Besides, 60 parts of calcium carbonate and 40 parts of water were mixed and dispersed for 10 hours by a ball mill, and 7 parts of thus obtained calcium carbonate dispersion 100 parts of 2% solution of Celogen BS-H, produced by Daiichi Kogyo Seiyaku Co., Ltd., were stirred for 5 minutes in a cooking mixer MX-915C, manufactured by Matsushita Denki Co., Ltd. Thus obtained liquid was referred to as Liquid B.

Using a stirrer, 50 parts of Liquid B and 50 parts of Liquid A were mixed to form a suspension and then the solvent was stilled out under a reduced pressure. Thereafter, 100 parts of 6 moles/liter solution of hydrochloric acid was added so as to dissolve and remove calcium carbonate. Thus obtained suspension was repeatedly subjected to filtering and washing and the filtered cake was dried by a blowing drier to obtain Toner intermediate particle 2.

Toner Intermediate Particle 3

To 25.6 kg of carbon black as a colorant, 11.98 kg of potassium persulfate and 265 l of deionized water were added and mixed, and the mixture was made up to a colorant dispersion by a compress-dispersing homogenizer NOH-70 manufactured by Nihon Seiki Seisakusho Co., Ltd.

To a 500 l GL reaction vessel on which a stirrer, a thermal sensor, a cooler and a nitrogen gas introducing device, 250 l of deaerated and deionized water and 16 l of the foregoing colorant dispersion were charged, and 27.86 kg of styrene, 5.22 kg of n-butyl acrylate, 1.16 kg of methacrylic acid and t-dodecylmercaptane were further added. The temperature in the vessel was raised by 75° C. while stirring the mixture with a stirring speed of 500 rpm under the nitrogen gas stream. A polymerization initiator solution composed of 0.82 kg of potassium persulfate and 60 l of deaerated and deionized water was added at the time when the temperature in the vessel was come by 75° C. After the polymerization for 7 hours, the reaction liquid was cooled by room temperature. The formed particle was measured by an electrophoresis light scatter photometer ELS-800, manufactured by Ootsuka Denshi Co., Ltd. Thus colorant complex polymer particle dispersion 1 was prepared.

To a 500 l stainless steel reaction vessel on which a stirrer having an anchor stirring wings, a thermal sensor, a cooler and a nitrogen gas introducing device, 150 l of the foregoing colorant complex polymer particle dispersion 1 was charged and stirred with a stirring speed of 100 rpm at room temperature. To the dispersion, 1.35 kg of Newcol 565C, produced by Nihon Nyukazai Co., Ltd., was added and stirred, and then a 5 mole/liter solution of hydrochloric acid was dropped so that the pH value is come to 9.60. Then a potassium chloride solution composed of 12.66 kg of potassium chloride and 70 l of deionized water was added, and a solution composed of 37 l of isopropanol, 1.00 kg of Newcol and 30 l of deionized water were further added. The temperature of the mixture at the completion of the addition was 29.0° C. The temperature of the mixture was raised by 85° C., and the reaction was performed for 6 hours at the liquid temperature of 85° C. and then the liquid was cooled to a room temperature of not more than 40° C. The fluctuation of the temperature in the period of the reaction was within the range of ±3° C. Thus formed non-spherical particles were filtered and suspended in distilled water and the pH of the dispersion was adjusted to 13 by a 1 mole/l sodium hydroxide solution to completely dissociate the carboxylic acid. The suspension particles were washed tow times each by 200 l of water and 7 timed each by 200 l of a mixture of water and methanol in a ratio of 7:3 to remove the impurity such as the ionic surfactant to some degree and filtered and dried. Thus Toner intermediate particle 3 was obtained.

Toner Intermediate Particle 4

Toner intermediate particle 4 was prepared in the same manner as in Toner intermediate particle 1 except that the solution composed of 12.1 g of magnesium hexahysrate and 1,000 l of water was replaced by a solution composed of 40.6 g of magnesium hexahysrate and 1,000 l of water and the amount of deionized water to be used for washing was increased by 12 times.

Toner Intermediate Particle 5

Preparation of Polymer Resin Containing Acidic Polar Group

| | |
|---|---|
| Styrene monomer (ST) | 60 parts |
| Butyl acrylate (BA) | 40 parts |
| Acrylic acid (AA) | 8 parts |

The above monomer mixture was added to an aqueous mixture of 100 parts of water, 1 part of nonionic emulsifying agent Emulgen 950, 1.5 parts of anionic emulsifying agent Neogen R and 0.5 parts of potassium persulfate, and polymerization was carried out for 8 hours at 70° C. while stirring. Thus a dispersion of acidic polar group-containing resin particle was obtained.

Preparation of Toner Intermediate Particle

| | |
|---|---|
| Acidic polar group-containing resin particle | 120 parts |
| Carbon black (Diablack #100) | 12 parts |
| Dispersion of Exemplified compound 19 | 15 parts |
| Water | 380 parts |

The above mixture was maintained at 30° C. for 2 hours while dispersing and stirred by a slasher and further stirred at 70° C. for 3 hours while stirring. Thus obtained liquefied suspension was dried in vacuum at 40° C. for 10 hours.

To 100 parts of the dried associated particle, 5 parts of 10% ethanol solution of a silane coupling agent A-143, produced by Nihon Unicar Co., Ltd., was sprayed and the surface of the particle was subjected to the coupling treatment for 50 hours at 40° C. to obtain Toner intermediate particle 5.

Toner Intermediate Particle 6

Toner intermediate particle 6 was prepared in the same manner as in Toner intermediate particle 3 except that the solution composed of 12.66 kg of potassium chloride and 70 l of deionized water was replaced by a solution composed of the same amount potassium chloride and 210 l of deionized water.

Toner Intermediate Particle 7

Toner intermediate particle 7 was prepared in the same manner as in Toner intermediate particle 5 except that the resin particle was cooled and washed by the water-methanol mixture at the time when the particle is grown by 1.5 μm.

Toner Intermediate Particle 8

Toner intermediate particle 8 was prepared in the same manner as in Toner intermediate particle 5 except that the spray of the silane coupling agent A-143, produced by Nihon Unicar Co., Ltd., was omitted.

through 8 and Comparative toners 1 through 4 were prepared and shown in Tables 2.

TABLE 1

| Toner No. | Inorganic oxide particle | Toner intermediate particle |
|---|---|---|
| Toner 1 | Inorganic oxide particle 1 | Toner intermediate particle 1 |
| Toner 2 | Inorganic oxide particle 1 | Toner intermediate particle 2 |
| Toner 3 | Inorganic oxide particle 1 | Toner intermediate particle 1 |
| Toner 4 | Inorganic oxide particle 1 | Toner intermediate particle 1 |
| Toner 5 | Inorganic oxide particle 1 | Toner intermediate particle 3 |
| Toner 6 | Inorganic oxide particle 1 | Toner intermediate particle 4 |
| Toner 7 | Inorganic oxide particle 2 | Toner intermediate particle 1 |
| Toner 8 | Inorganic oxide particle 3 | Toner intermediate particle 1 |
| Comparative toner 1 | Inorganic oxide particle 4 | Toner intermediate particle 5 |
| Comparative toner 2 | Inorganic oxide particle 5 | Toner intermediate particle 6 |
| Comparative toner 3 | Inorganic oxide particle 6 | Toner intermediate particle 7 |
| Comparative toner 4 | Inorganic oxide particle 7 | Toner intermediate particle 8 |

TABLE 2

| | Inorganic oxide | | | | Toner (Toner particle) | | | | | | |
|---|---|---|---|---|---|---|---|---|---|---|---|
| Samples | Average Feret's diameter | Ratio of average diameter ± 10% | Inorganic oxide composition | Moisture content | Ratio of particle having a shape factor of from 1.2 to 1.6 (%) | Variation coefficient of shape factor (%) | Variation coefficient of number distribution (%) | Number average diameter of colored particle | Moisture content | BET value | Existence density of inorganic oxide particles (110–160 nm) on the surface |
| Toner 1 | 135 | 76 | Silica | 8.2 | 65.8 | 15.8 | 24.2 | 5.2 | 0.8 | 1.5 | 21 |
| Toner 2 | 135 | 76 | Silica | 8.2 | 65.4 | 15.4 | 24.5 | 5.1 | 1.1 | 1.4 | 12 |
| Toner 3 | 135 | 76 | Silica | 8.2 | 65.8 | 15.8 | 24.2 | 5.2 | 0.9 | 1.8 | 28 |
| Toner 4 | 135 | 76 | Silica | 8.2 | 65.8 | 15.8 | 24.2 | 5.2 | 0.9 | 1.1 | 7 |
| Toner 5 | 135 | 76 | Silica | 8.2 | 65.1 | 15.2 | 26.4 | 5.1 | 1.0 | 4.1 | 48 |
| Toner 6 | 135 | 76 | Silica | 8.2 | 67.8 | 15.2 | 25.8 | 9.5 | 1.9 | 2.0 | 33 |
| Toner 7 | 120 | 93 | Silica | 13.4 | 65.8 | 15.8 | 24.2 | 5.2 | 0.8 | 1.6 | 30 |
| Toner 8 | 156 | 85 | Silica | 4.3 | 65.8 | 15.8 | 24.2 | 5.2 | 0.8 | 1.4 | 16 |
| Comparative toner 1 | 102 | 65 | Silica | 3.7 | 66.5 | 14.8 | 23.4 | 9.2 | 0.1 | 1.0 | 3 |
| Comparative toner 2 | 180 | 62 | Silica | 13.4 | 71.2 | 15.7 | 25.1 | 1.8 | 2.2 | 4.4 | 58 |
| Comparative toner 3 | 105 | 64 | Silica | 1.2 | 67.5 | 14.5 | 24.1 | 1.8 | 0.1 | 4.8 | 4 |
| Comparative toner 4 | 170 | 66 | Silica | 12.7 | 66.4 | 14.9 | 26.2 | 9.5 | 2.3 | 1.0 | 62 |

(3) Preparation of Toner

To 100 parts of each kinds of the toner intermediate particle, 1 part of silicone oil-treated hydrophobic silica having an average particle diameter of 14 nm and 2 parts of inorganic oxide particles prepared above were mixed in the combination shown in Table 1. The mixing was performed for 25 minutes at a circumference speed of the rotating wing of a Henschel mixer of 30 m per second. Thus, Toners 1

Evaluation by Practical Use

The evaluation was carried out by a digital copying machine having the constitution shown in FIG. 1. In the copying machine, corona charging, exposure by laser, reversal development by two-component developer, transfer by roller and the cleaning-less system were applied. The following photoreceptor was installed in the copying machine, and the evaluation was carried out under the later-mentioned charging, exposure and developing condition.

Preparation of Photoreceptor

The photoreceptor 1 was prepared as follows.

Preparation of Intermediate Layer Coating Liquid

| | |
|---|---|
| Polyamide resin, Amilan CM-800 (Toray Co., Ltd.) | 60 g |
| Methanol | 1600 g |
| 1-butanol | 400 g |

The above materials were mixed and dissolved to prepare an intermediate layer coating liquid.

The coating liquid was coated on a cylindrical aluminum substrate by a dipping coating method to form an intermediate layer having a thickness of 0.3 μm.

Preparation of Charge Generation Layer Coating Liquid

| | |
|---|---|
| Titanylphthalocyanine | 60 g |
| Silicone resin solution, 15% xylene/butanol solution of KR-4250 (Shin' etsu Kagaku Co., Ltd.) | 700 g |
| 2-butanone | 2000 ml |

The above materials was mixed and dispersed for 10 hours by a sand mill to prepare a charge generation layer coating liquid.

The coating liquid was coated on the foregoing intermediate layer by a dipping coating method to form a charge generation layer having a thickness of 0.2 μm.

Preparation of Charge Transfer Layer Coating Liquid

| | |
|---|---|
| Charge transfer material, 4-methoxy-4'-(4-methyl-α-phenylstyryl) triphenylamine | 200 g |
| Bisphenol Z type polycarbonate, Iupilon Z 300 (Mitsubishi Gas Kagaku Co., Ltd.) | 300 g |
| 1,2-dichloroethane | 2000 ml |

The above materials were mixed and dissolved to prepare a charge transfer layer coating liquid.

The coating liquid was coated on the foregoing charge generation layer by a dipping coating method to form a charge transfer layer having a thickness of 20 μm.

Preparation of Resin Layer Coating Liquid

To 10 parts of polysiloxane resin derived from 80 mole-% of methylsiloxane unit and 20 mole-% of methyl-phenylsiloxane unit, molecular sieve A and stood for 15 hours for dehydrating treatment.

The resin was dissolved in 10 parts of toluene, and 5 parts of methyltrimethoxysilane and 0.2 parts of dibutyl tin acetate were added to the solution to prepare a uniform solution. To the solution, 6 parts of dihydroxymethyltriphenylamine and 0.3 parts of hindered amine was mixed to prepare a resin layer coating liquid. The coating liquid was coated on the foregoing charge transfer layer and subjected to a hardening treatment by heating for 1 hour at 120° C.

Charging, Exposing and Developing Condition

Charging Condition

Charging device: Scorotron charging device; Initial charging potential was −750 V.

Exposing Condition

Exposure light amount was set so as to make the potential at the exposed area to −50 V.

Developing Condition

DC bias: −550 V

Transferring Condition

Corona Charging Method

A fixing device having the constitution shown in FIG. 3 was used. In the fixing device, a heating roller and a pressure roller were used. The heating roller was constituted by a metal core of iron covered with a layer of tetrafluoroethylene-perfluoroalkylvinyl ether copolymer PFA of 25 μm having a surface roughness of 0.8 μm, and the pressure roller was constituted by a metal core of iron covered with a layer of HTV silicone rubber and a tube of PFA with a thickness of 120 μm arranged on the silicone rubber layer. The nip width was 3.8 mm, and the line speed was 420 mm per second.

Any cleaning mechanism and silicone oil supplying mechanism were not provided to the fixing device. The fixing temperature was controlled according to the surface temperature of heating roller, which was set at 165° C.

The copying tests were carried out with respect to each of the above-obtained Toners 1 through 8 and Comparative toners 1 through 4 using the foregoing image forming apparatus according to the invention. Copying was continuously performed for 600,000 times under a high temperature and high humidity condition of a temperature of 30° C. and a relative humidity of 85% and further continuously 600,000 times under a low temperature and low humidity condition of a temperature of 10° C. and a relative humidity of 20%. The evaluation was performed with respect to the following items.

(1) Transfer in the Cleaning-Less System

The developing condition or the rotating speed of the developing roller was adjusted so that the amount of the toner adhered on the solid image formed on the photoreceptor was to be 0.8 mg/cm$^2$, and an image of 5.6 point characters on full page was continuously printed by 20 sheets.

After the printing, the remained character image caused by insufficient cleaning was evaluated.

A: No remained character image was observed on both of the photoreceptor and the image receiving paper.

B: The remaining character images were slightly observed on the photoreceptor by no image was observed on the image receiving paper. There was no problem for the practical use.

C: The remained character could be lead on the image receiving paper.

(2) Unevenness of Image Density

The filming on the photoreceptor and the uniformity of halftone image depending on the variation of the transferring were evaluated as to the copy after 500,000 copies. The results were classified into the following ranks.

A: Uniform image without any unevenness

B: A line-shaped unevenness was slightly observed.

C: Several lines of weak unevenness were observed but the level of the unevenness not caused any practical problem.

D: Many lines of clear unevenness were observed.

In the above ranks, A and B were acceptable and C and D was unacceptable for practical use.

(3) Image Scattering

On whole of the image, 10% dot image was formed, and the scattering at the circumference of the dot was observed through a loupe.

A: The scattering was almost not detected.

B: The scattering was slightly detected only when the observation was carefully performed.

C: The scattering was easily detected.

The results of the evaluation are shown in Table 3.

TABLE 4

| Example No. | Toner No. | Transfer ability in cleaner-less system | Unevenness of image density | Image scattering |
|---|---|---|---|---|
| Example 1 | Toner 1 | A | A | A |
| Example 2 | Toner 2 | A | A | B |
| Example 3 | Toner 3 | A | A | B |
| Example 4 | Toner 4 | A | B | B |
| Example 5 | Toner 5 | A | B | B |
| Example 6 | Toner 6 | A | B | A |
| Example 7 | Toner 7 | A | B | A |
| Example 8 | Toner 8 | A | B | A |
| Comparative example 1 | Comparative Toner 1 | C | C | C |
| Comparative example 2 | Comparative Toner 2 | C | C | C |
| Comparative example 3 | Comparative Toner 3 | C | C | C |
| Comparative example 4 | Comparative Toner 4 | C | C | C |

A is cleared in Table 3, Examples 1 through 8 within the invention show results acceptable for practical use, but the comparative examples 1 through 4 each causes the problems on the practical use.

The toner for developing a static latent image and the image forming method can be provided by the invention, by which an image excellent in the transfer property and the resolving power and the application of the cleaner-less process is made possible.

What is claimed is:

1. A static latent image developing toner comprising toner particles, each of the toner particles comprising a toner intermediate particle having inorganic oxide particles on the surface, wherein a surface existence density of the inorganic oxide particle having a feret's diameter of 110 nm to 160 nm on the toner intermediate particle is 5 to 50 per $\mu m^2$.

2. The static latent image developing toner of claim 1, wherein the sur-face existence density is 10 to 30 per $\mu m^2$.

3. The static latent image developing toner of claim 2, wherein the toner is prepared by adding inorganic oxide particles, which has an number average feret's diameter of 110 to 160 nm, to the toner intermediate particles, and 70 number-% or more of the inorganic oxide particles has a feret's diameter of ±10% of the number average feret's diameter.

4. The static latent image developing toner of claim 3, wherein the toner particles has a number average diameter of 2 to 9 μm.

5. The static latent image developing toner of claim 4, wherein 65 number-% or more of the toner particles in the toner has a shape factor of 1.2 to 1.6, and a variation coefficient of the shape factor of the toner particles is within 4 to 16%.

6. The static latent image developing toner of claim 5, wherein the toner particles have a number variation coefficient in a number distribution of particle size of 8 to 27%.

7. The static latent image developing toner of claim 1, wherein a moisture content of the inorganic oxide particles is 4 to 12 weight %, and a moisture content of the toner is 0.2 to 2 weight-%.

8. The static latent image developing toner of claim 7, wherein the moisture content of the toner is 0.6 to 1.5 weight-%.

9. The static latent image developing toner of claim 8, wherein the moisture content of the toner is 0.7 to 1.2 weight-%.

10. The static latent image developing toner of claim 1, wherein the toner is prepared by adding inorganic oxide particles, which has an number average feret's diameter of 110 to 160 nm, to the toner intermediate particles, and 70 number-% or more of the inorganic oxide particles has a feret's diameter of ±10% of the number average feret's diameter.

11. The static latent image developing toner of claim 10, wherein the toner particles has a number average diameter of 2 to 9 μm.

12. The static latent image developing toner of claim 1, wherein the toner particles has a number average diameter of 2 to 9 μm.

13. The static latent image developing toner of claim 1, wherein 65 number-% or more of the toner particles in the toner has a shape factor of 1.2 to 1.6, and a variation coefficient of the shape factor of the toner particles is within 4 to 16%.

14. The static latent image developing toner of claim 13, wherein the toner particles have a number variation coefficient in a number distribution of particle size of 8 to 27%.

15. The static latent image developing toner of claim 1, wherein the toner particles have a number variation coefficient in a number distribution of particle size of 8 to 27%.

16. The static latent image developing toner of claim 1, wherein the inorganic oxide particles are silica particles.

17. The static latent image developing toner of claim 16, wherein the inorganic oxide particles are hydrophobic silica particles.

18. A developer for developing a static latent image comprising the static latent image developing toner of claim 1.

* * * * *